US008905394B2

(12) United States Patent
Miyake et al.

(10) Patent No.: US 8,905,394 B2
(45) Date of Patent: Dec. 9, 2014

(54) SHEET POST-PROCESSING APPARATUS WITH AN ALIGNMENT-SIDE DETERMINATION FEATURE

(71) Applicant: Canon Kabushiki Kaisha, Tokyo (JP)

(72) Inventors: Toshiyuki Miyake, Abiko (JP); Mitsuhiko Sato, Kashiwa (JP); Takashi Yokoya, Kashiwa (JP); Hiromasa Maenishi, Matsudo (JP); Yutaka Ando, Toride (JP); Akihiro Arai, Toride (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/734,297

(22) Filed: Jan. 4, 2013

(65) Prior Publication Data

US 2013/0175753 A1 Jul. 11, 2013

(30) Foreign Application Priority Data

Jan. 6, 2012 (JP) ..... 2012-001372

(51) Int. Cl.
*B65H 37/04* (2006.01)

(52) U.S. Cl.
CPC ..... *B65H 37/04* (2013.01)
USPC ..... 270/58.11; 270/58.09; 270/58.12; 399/410

(58) Field of Classification Search
CPC ..... B65H 37/04
USPC ..... 270/58.08, 58.09, 58.11, 58.12, 58.13; 399/410
See application file for complete search history.

(56) References Cited

U.S. PATENT DOCUMENTS

| | | | | |
|---|---|---|---|---|
| 5,642,876 | A * | 7/1997 | Ferrara et al. | 270/58.01 |
| 5,772,198 | A * | 6/1998 | Yamamoto | 270/58.12 |
| 6,371,472 | B1 * | 4/2002 | Miyake et al. | 270/58.14 |
| 7,954,801 | B2 * | 6/2011 | Fukami | 270/58.11 |
| 2006/0279037 | A1 * | 12/2006 | Kushida et al. | 270/58.08 |

FOREIGN PATENT DOCUMENTS

| | | | |
|---|---|---|---|
| JP | 07-172672 | A | 7/1995 |
| JP | 10-181988 | A | 7/1998 |
| JP | 10181988 | A * | 7/1998 |

* cited by examiner

*Primary Examiner* — Patrick Mackey
(74) *Attorney, Agent, or Firm* — Rossi, Kimms & McDowell LLP

(57) ABSTRACT

A sheet post-processing apparatus that is capable of aligning a sheet bundle accurately even if sheet types like sheet sizes are different, and is capable of setting a reference position depending on a selected finish. A conveyance unit conveys a sheet. A sheet stacking unit stacks sheets conveyed by the conveyance unit as a sheet bundle. A stapler applies a staple process to the sheet bundle stacked on the sheet stacking unit. A position determination unit determines a staple position at which the staple process is applied to the sheet bundle. An alignment unit aligns the sheets stacked on the sheet stacking unit in a direction perpendicular to a sheet conveyance direction with respect to one of both sides parallel to the sheet conveyance direction. The alignment unit determines the one side as a reference side depending on the staple position determined by the position determination unit.

15 Claims, 21 Drawing Sheets

FINISH MENU SELECTION SCREEN

STAPLE SETTING SCREEN (CORNER BINDING)

STAPLE SETTING SCREEN (DOUBLE BINDING)

DOUBLE BINDING (LEFT)

CORNER BIDING (UPPER LEFT)

CORNER BIDING (UPPER LEFT)
(ALIGNMENT MODE: REAR SIDE)

CORNER BIDING (LOWER LEFT)
(ALIGNMENT MODE: FRONT SIDE)

CORNER BIDING (UPPER RIGHT)
(ALIGNMENT MODE: FRONT SIDE)

CORNER BIDING (LOWER RIGHT)
(ALIGNMENT MODE: REAR SIDE)

DOUBLE BINDING (LEFT)
(ALIGNMENT MODE: FRONT SIDE)

DOUBLE BINDING (RIGHT)
(ALIGNMENT MODE: REAR SIDE)

*FIG. 14*

| POST-PROCESSING-MODE | POST-PROCESSING-POSITION | WAITING POSITION OF STAPLER 601 | ALIGNMENT DIRECTION |
|---|---|---|---|
| CORNER BINDING | UPPER LEFT | D: CORNER BINDING (REAR) | REAR SIDE |
| | LOWER LEFT | A: CORNER BINDING (FRONT) | FRONT SIDE |
| | UPPER RIGHT | A: CORNER BINDING (FRONT) | FRONT SIDE |
| | LOWER RIGHT | D: CORNER BINDING (REAR) | REAR SIDE |
| DOUBLE BINDING | LEFT | B: DOUBLE BINDING (FRONT) | FRONT SIDE |
| | RIGHT | B: DOUBLE BINDING (FRONT) | REAR SIDE |

APPLICATION MODE SELECTION SCREEN

ALIGNMENT MODE SELECTION SCREEN

SHEET POST-PROCESSING APPARATUS WITH AN ALIGNMENT-SIDE DETERMINATION FEATURE

BACKGROUND OF THE INVENTION

1. Field of the Invention

The present invention relates to a sheet post-processing apparatus that applies a post process to a sheet, and particularly, relates to a sheet post-processing apparatus that is used with an image forming apparatus, such as a copying machine or a laser beam printer, and a control method therefor.

2. Description of the Related Art

A sheet post-processing apparatus (a finisher) is arranged at the downstream position of an image forming apparatus (a copying machine etc.) in a sheet conveyance direction, and applies post-processes, such as a staple process and a punching process, to a conveyed sheet bundle.

Such sheet post-processing apparatuses sequentially stacks sheets that are received from an image forming apparatus onto a processing tray that is arranged at the upstream position of a stacking tray. In such an apparatus, stacked sheet bundle is aligned by adjusting both sides of sheets in a width direction perpendicular to the sheet conveyance direction by alignment members. After all the sheets that comprise one booklet are stacked on the processing tray, a post process, such as a staple process, is performed on the processing tray. Then, the sheet bundle to which the post process was performed is ejected from the processing tray to the stacking tray (see Japanese Laid-Open Patent Publication (Kokai) No. H10-181988 (JP H10-181988A)).

The sheet post-processing apparatus disclosed in this publication is provided with a skew feeding roller for giving a sheet the moment toward one of the alignment members in order to improve the adjustment of the sheets on the processing tray.

Incidentally, the sheet post-processing apparatus disclosed in JP H10-181988A is assuming that all the sheets included in the sheet bundle that is the target of the alignment process on the processing tray have the same width.

However, actual sizes (actual measurement) of sheets of some manufacturers or brands are often different from nominal sizes. In addition, there may be lot-to-lot unevenness or sheet-to-sheet unevenness in sheets of the same brand. It is known that the degree of shrinkage of a sheet after fixing by an image forming apparatus varies depending on the material type of the sheet.

Under the condition where sheets of different brands or material types are mixed in one booklet, when an alignment process is performed with reference to the sheet with the maximum width, it becomes difficult to align sheets with the smaller width than the maximum width. As a result, there is a possibility that a booklet is generated in the state where some sheets are in unfixed positions between the alignment members and are not parallel.

On the other hand, when the alignment process is performed with reference to the sheet with the minimum width, there is a possibility that an edge of the sheet with the larger width than the minimum width is wrinkled or torn.

The sheet post-processing apparatus disclosed in Japanese Laid-Open Patent Publication (Kokai) No. H7-172672 (JP H7-172672A) is able to stack sheets on a processing tray by giving a sheet the moment toward one of the alignment members as a reference position by a skew feeding roller of the processing tray even if the sheet width is uneven.

However, it is necessary to change the reference position depending on contents of post process or a position at which the post process is performed. For example, when one side of sheet bundle is bound at two positions, it is preferable that the "bottom" of the booklet is the reference position in consideration of keeping the booklet in a bookshelf.

However, the top and bottom of the sheet bundle stacked on the processing tray are changed according to which of the right-side and left-side opens is selected by a user in the case of the double binding. That is, since the alignment member used as the reference position is predetermined in the sheet post-processing apparatus of JP H7-172672A, the "bottom" side of a booklet cannot become the reference position when some finishes are selected.

SUMMARY OF THE INVENTION

The present invention provides a sheet post-processing apparatus and a control method therefor, which are capable of aligning a sheet bundle accurately even if sheet types like sheet sizes are different, and are capable of setting a reference position depending on a selected finish.

Accordingly, a first aspect of the present invention provides a sheet post-processing apparatus comprising a conveyance unit configured to convey a sheet; a sheet stacking unit configured to stack sheets conveyed by the conveyance unit as a sheet bundle, a stapler configured to apply a staple process to the sheet bundle stacked on the sheet stacking unit, a position determination unit configured to determine a staple position at which the staple process is applied to the sheet bundle, and an alignment unit configured to align the sheets stacked on the sheet stacking unit in a width direction that intersects perpendicularly with a conveyance direction of a sheet conveyed by the conveyance unit with respect to one of both sides parallel to the sheet conveyance direction, wherein the alignment unit determines the one side as a reference side depending on the staple position determined by the position determination unit.

Accordingly, a second aspect of the present invention provides a control method for a sheet post-processing apparatus having a conveyance unit that conveys a sheet, a sheet stacking unit that stacks sheets conveyed by the conveyance unit as a sheet bundle, and a stapler that applies a staple process to the sheet bundle stacked on the sheet stacking unit, the control method comprising a first determination step of determining a staple position at which the stapler process is applied to the sheet bundle, a second determination step of determining one of both sides of the sheet parallel to the sheet conveyance direction as a reference side depending on the staple position determined in the first determination step, and an alignment step of aligning the sheets stacked on the stacking unit with respect to the reference side determined in the second determination step.

According to the present invention, a sheet bundle is accurately aligned even if sheet types like sheet sizes are different, and the reference position can be established depending on a selected finish.

Further features of the present invention will become apparent from the following description of exemplary embodiments with reference to the attached drawings.

BRIEF DESCRIPTION OF THE DRAWINGS

FIG. 14 is a view showing an example of an alignment direction table stored in a ROM shown in FIG. 6.

DESCRIPTION OF THE EMBODIMENTS

Hereafter, embodiments according to the present invention will be described in detail with reference to the drawings.

Figure 1:
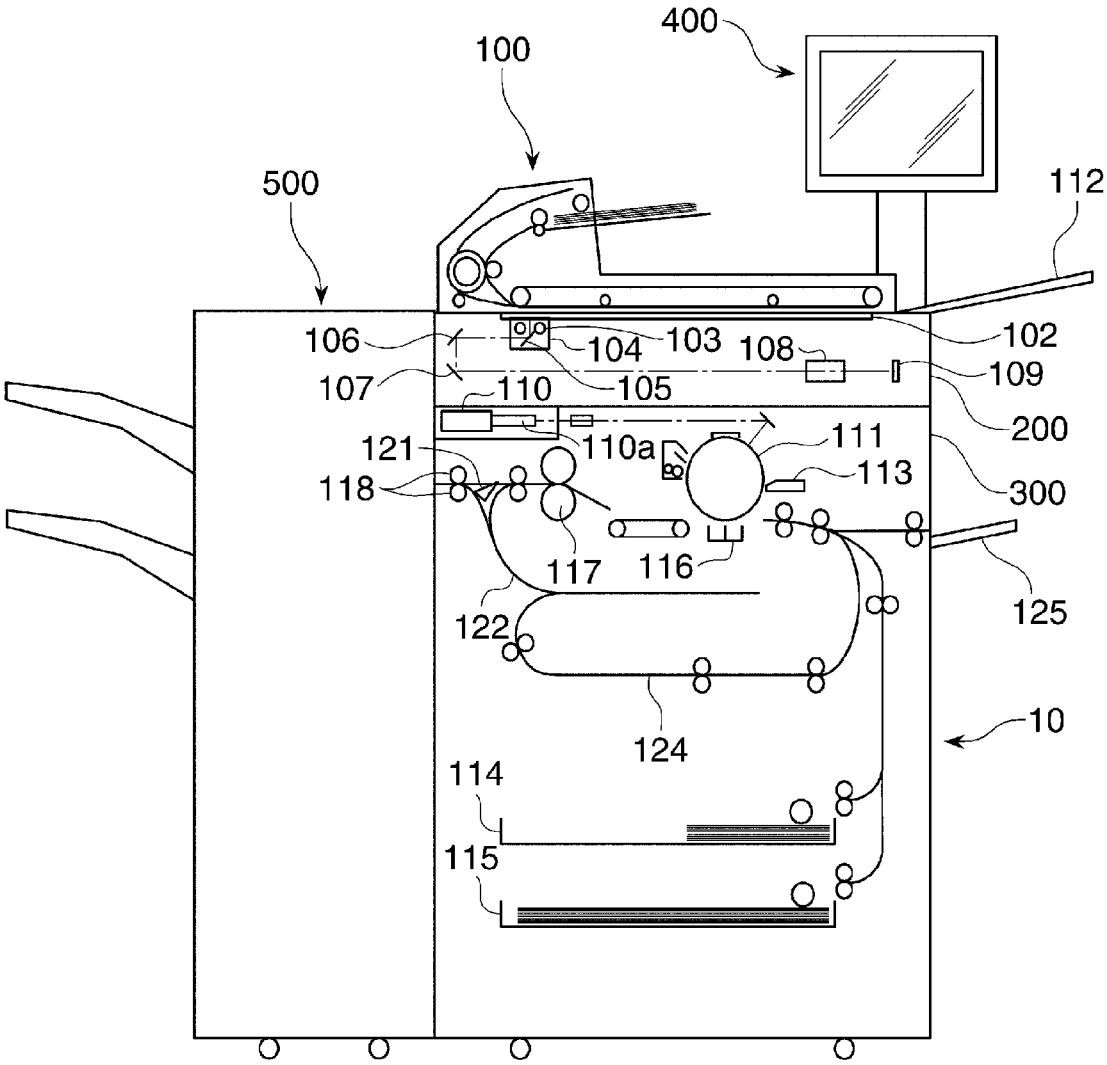
FIG. 1 is a view schematically showing a configuration of an image forming apparatus that is used with a sheet post-processing apparatus (a finisher) according to a first embodiment of the present invention.

FIG. 1 is a view schematically showing a configuration of an image forming apparatus that is used with a sheet post-processing apparatus (a finisher) according to a first embodiment of the present invention.

A finisher 500 is connected to the image forming apparatus 10. The finisher 500 is arranged at the downstream of an image forming apparatus 10 in a sheet conveyance direction. The image forming apparatus 10 is provided with an image reader 200 that reads an image of an original, and a printer 300 that prints the read image onto a sheet.

An original feeding device 100 is mounted on the image reader 200. The original feeding device 100 feeds originals that are upwardly set (set a reading side up) on an original tray one by one from the top page leftward in FIG. 1. An original is sent onto a platen glass 102 via a curved path, and is conveyed over a reading position from left to right. Then, the original is ejected to a sheet ejection tray 112.

When an original passes the reading position, an image on the original is read by a scanner unit 104 arranged at a position corresponding to the reading position.

Specifically, when an original passes the reading position, a reading surface of the original is irradiated with a lamp 103 in the scanner unit 104, and the reflected light from the original is guided to a lens 108 via mirrors 105, 106, and 107. The light passed through the lens 108 forms an image on an imaging surface of an image sensor 109.

Thus, the original is read by conveying the original so as to pass the reading position from left to right. Here, a width direction that intersects perpendicularly to the conveyance direction of the original is a principal scanning direction and the conveyance direction is an auxiliary scanning direction. That is, the entire image of the original is read by conveying the original in the auxiliary scanning direction while reading the original line by line in the principal scanning direction by the image sensor 109 when the original passes the reading position. Then, the image read optically is converted into an electrical signal (image signal) by the image sensor 109.

The image signal outputted from the image sensor 109 is inputted into an exposure control unit 110 of the printer 300 as a video signal, after a predetermined process is performed in an image signal control unit 922 (FIG. 2) mentioned later.

It should be noted that the original feeding device 100 may convey the original to the platen glass 102 and stop the original at a predetermined position on the platen glass 102. In such a case, the original is read by scanning the scanner unit 104 from left to right in FIG. 1.

When reading an original without using the original feeding device 100, a user lifts the original feeding device 100 and lays the original on the platen glass 102. Then, the original is read by scanning the scanner unit 104 from left to right in FIG. 1.

The exposure control unit 110 modulates a laser beam based on the video signal and outputs the laser beam modulated. The laser beam concerned is deflected and scanned by a polygon mirror 110*a* and is irradiated on a photosensitive drum 111. As a result of this, an electrostatic latent image responsive to a video signal is formed on the photosensitive drum 111. The electrostatic latent image on the photoconductive drum 111 is developed by a development device 113 and is visualized as a toner image.

A sheet is fed from a cassette 114, a cassette 115, a manual sheet feeder 125, or a double-sided conveyance path 124 at the timing in synchronization with the irradiation start of the laser beam. This sheet is conveyed to a transfer position specified by the photosensitive drum 111 and a transfer unit 116. Then, the toner image formed on the photosensitive drum 111 is transferred to the sheet by the transfer unit 116.

Then, the sheet is conveyed to a fixing unit 117. The fixing unit 117 applies heat and pressure to the sheet to fix the toner image to the sheet. Then, the sheet passed through the fixing unit 117 is ejected from the printer 300 to the finisher 500 through a flapper 121 and an ejection roller pair 118.

When the sheet is ejected with the image formation side down (face down), the sheet passed through the fixing unit 117 is once guided in an inversion path 122 by a switching operation of the flapper 121. Then, after the rear edge of the sheet passes the flapper 121, the sheet is moved back and is ejected from the printer 300 by the sheet ejection roller pair 118. This ejection mode is called an inverted ejection.

Figure 2:
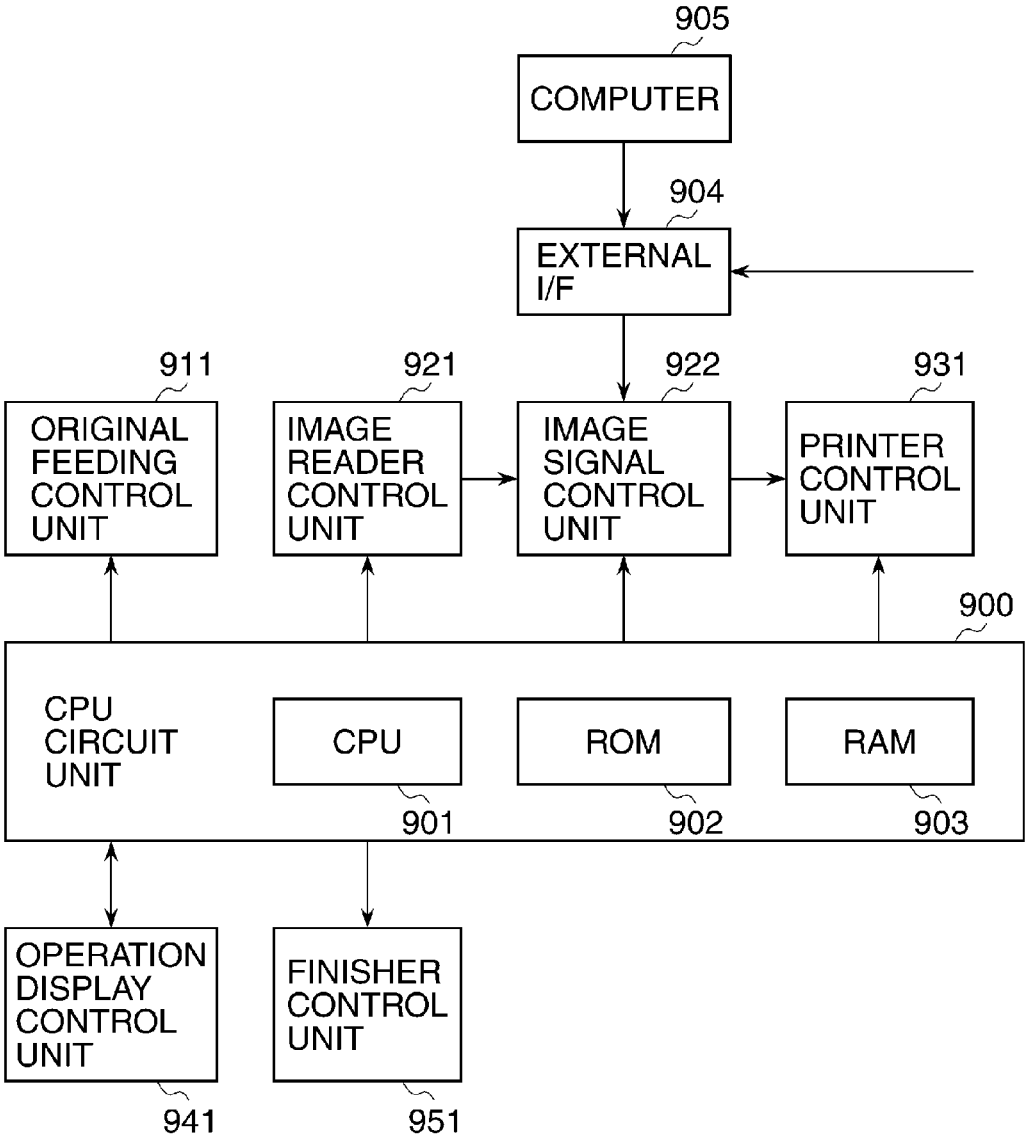
FIG. 2 is a block diagram showing a configuration example of a controller that controls the image forming apparatus and the finisher shown in FIG. 1.

This inverted ejection is used when forming images sequentially from the top page, i.e., when reading images on originals using the original feeding device 100 or when forming image responsive to the image data outputted from the computer 904 (FIG. 2).

When a double-sided printing, which forms images on both sides of a sheet, is set, the sheet is guided to the inversion path 122 by the switching operation of the flapper 121, and then, the sheet is conveyed to a double-sided conveyance path 124. Then, the sheet guided to the double-sided conveyance path 124 is fed to the transfer position again at the above-mentioned timing.

As mentioned above, the sheet ejected from the printer 300 is sent to the finisher 500, and the finisher 500 applies post-processes (a binding process etc.) to the sheet as mentioned later.

FIG. 2 is a block diagram showing a configuration example of a controller that controls the image forming apparatus 10 and the finisher 500 shown in FIG. 1.

The controller is provided with a CPU circuit unit 900. The CPU circuit unit 900 has a CPU 901, a ROM 902, and a RAM 903. Then, the CPU 901 is connected to the ROM 902 and the RAM 904 via an address bus (not shown) and a data bus (not shown).

The ROM 902 stores a control program. The CPU 901 controls the image forming apparatus 10 and the finisher 500 according to the control program. That is, the CPU 901 controls an original feeding control unit 911, an image reader control unit 921, an image signal control unit 922, a printer control unit 931, an operation display control unit 941, and a finisher control unit 951 collectively according to the control program. The RAM 903 stores control data temporarily, and the RAM 903 is further used as a working area for data processing accompanying control.

The original feeding control unit 911 controls to drive the original feeding device 100 under the control by the CPU 901. The image reader control unit 921 controls the scanner unit 104, the image sensor 109, etc., and transmits the image signal (an analog signal) outputted from the image sensor 109 to the image signal control unit 922.

After converting the image signal into a digital signal, the image signal control unit 922 generates image data by applying various processes to the digital signal. Then, the image signal control unit 922 converts the image data into a video signal, and sends it to the printer control unit 931.

As shown in FIG. 2, a computer 905 is connected to the image signal control unit 922 via an external interface (I/F) 904. When receiving a digital image signal from the computer 905 via the external I/F 904, the image signal control unit 922 applies various processes to the digital image signal. Then, the image signal control unit 922 converts the image signal to which the various processes were applied into the video signal for printing, and sends it to the printer control unit 931. It should be noted that the processes by the image signal control unit 922 is performed under the control by the CPU 901.

The printer control unit 931 controls the exposure control unit 110 and the printer 300 based on the video signal, and controls an image formation and a sheet conveyance as mentioned above.

The finisher control unit 951 is mounted on the finisher 500 shown in FIG. 1. The finisher control unit 951 communicates with the CPU 901, and controls to drive the finisher 500. It should be noted that the control of the finisher control unit 951 will be described later.

The operation display control unit 941 controls an operation display unit 400 attached to the image forming apparatus 10 as shown in FIG. 1 under the control by the CPU 901. The operation display unit 400 has a plurality of keys for setting various functions about image formation, a display unit for displaying information showing set state, etc.

The operation display control unit 941 sends a key signal responsive to an operation of a key to the CPU 901. The operation display control unit 941 displays the information shown by a display control signal sent from the CPU 901 on the operation display unit 400.

Figure 3:
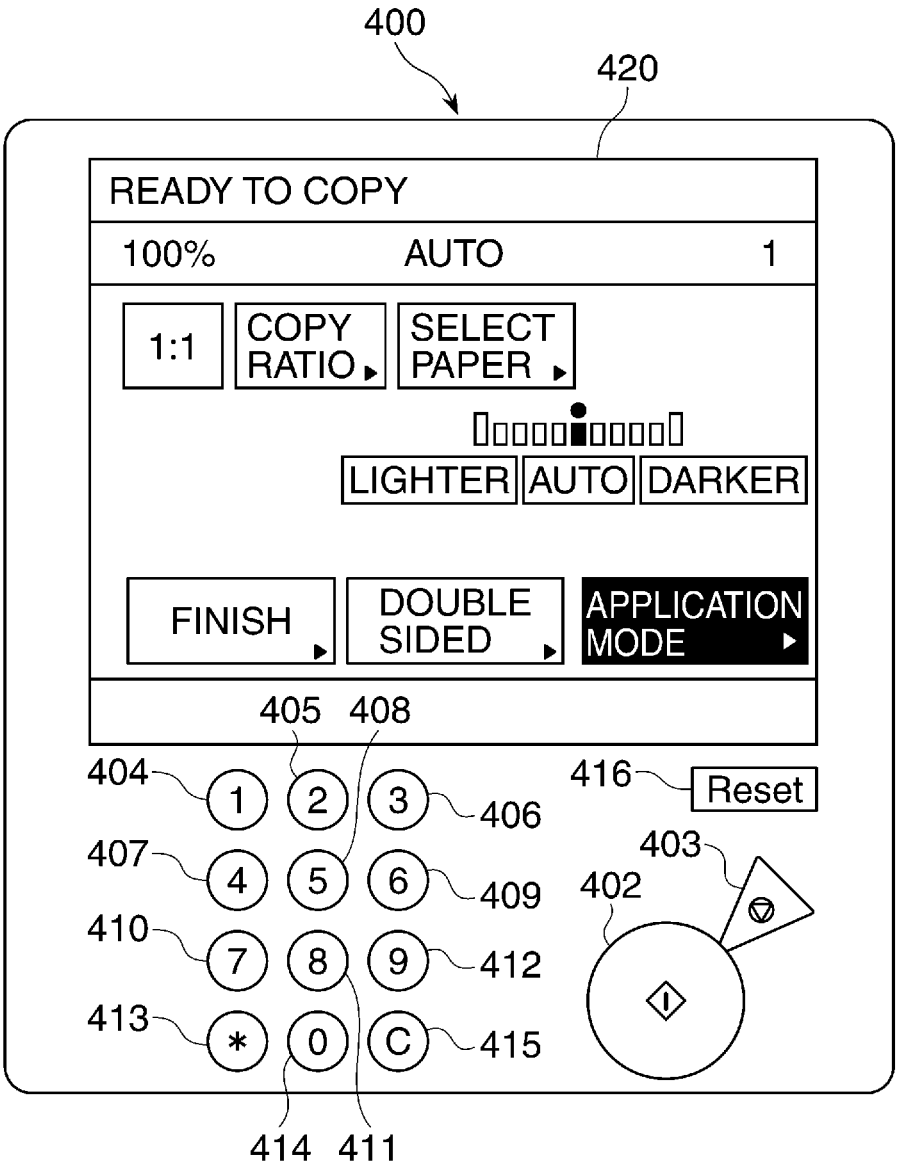
FIG. 3 is a view showing a configuration of an operation display unit with which the image forming apparatus shown in FIG. 1 is provided.

FIG. 3 is a view showing a configuration of the operation display unit 400 with which the image forming apparatus 10 shown in FIG. 1 is provided.

The operation display unit 400 is provided with a start key 402 and a stop key 403 as shown in FIG. 3. The start key 402 is operated when a user starts image formation. The stop key 403 is operated when a user interrupts image formation.

The operation display unit 400 is provided with ten keys 404 through 412 and 414 for entering numeric values, a clear key (C) 415, a reset key (Reset) 416, a user mode key 413 that is used to perform various kinds of setting, etc.

The operation display unit 400 has the display unit 420. A touch panel is arranged on the surface of this display unit 420, which allows forming soft keys on the screen of the display unit 420.

The finisher 500 of the embodiment has post-processing modes, such as a non sorting mode, a sorting mode, a staple sorting mode (a binding mode), and a bookbinding mode. The processing mode concerned is set up by an operation through the operation display unit 400. For example, when setting up a post-processing mode, a selection of a "FINISH" key in an initial screen shown in FIG. 3 causes a display of a menu selection screen for finishing a sheet bundle on the display unit 420. Then, a user can set the post-processing mode using this menu selection screen.

Figure 4:
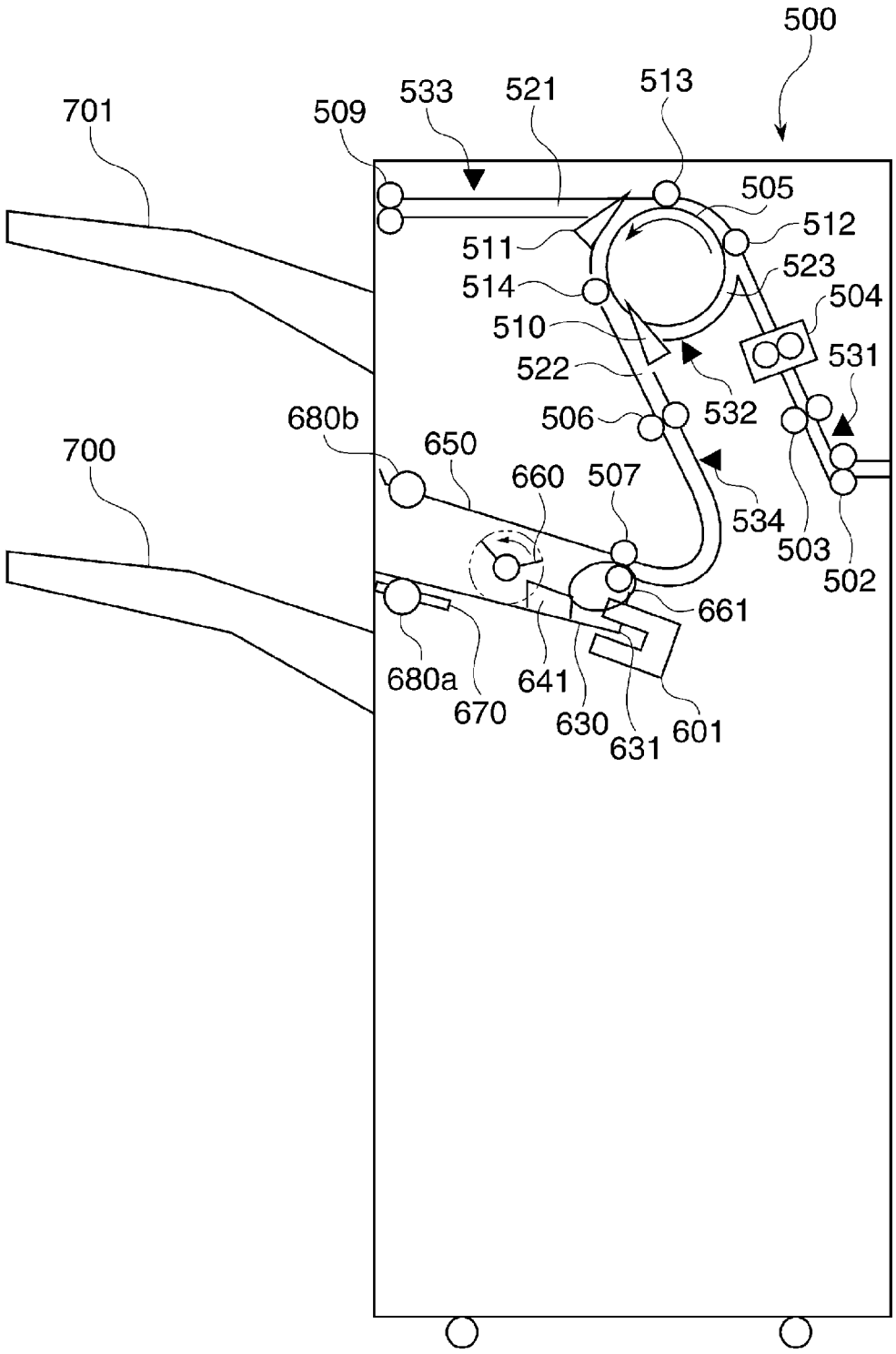
FIG. 4 is a view showing a configuration example of the finisher shown in FIG. 1.

FIG. 4 is a view showing a configuration example of the finisher 500 shown in FIG. 1.

As mentioned above, the finisher 500 takes in sheets ejected from the image forming apparatus 10 one by one. Then, the finisher 500 applies post processes to a plurality of sheets. These post processes include a process for aligning and bundling sheets as one bundle, a staple process for binding a rear end of a sheet bundle by a staple, a sorting process, etc., for example.

The finisher 500 has an entrance roller pair 502, and takes in sheets ejected from the image forming apparatus 10 by this entrance roller pair 502. At this time, a single-sided image formation sheet will be ejected with the image formation side down from the image forming apparatus 10. A double-sided image formation sheet will be ejected with the image on the front side down from the image forming apparatus 10. The sheet taken inside by the entrance roller pair 502 is conveyed to a buffer roller 505 by conveying roller pairs 503 and 504. A conveyance sensor 531 is arranged between the entrance roller pair 502 and the conveying roller pair 503, and passage of a sheet is detected by the conveyance sensor 531.

Sheets of the predetermined number can be wound around the buffer roller 505 in overlapped fashion. Depression rollers 512, 513, and 514 are arranged around the buffer roller 505, and a sheet is wound around the buffer roller 505 by the depression rollers 512, 513, and 514. Then, the sheets wound around the buffer roller 505 are conveyed in the rotation direction of the buffer roller 505.

The path switching flapper 511 is arranged between the depression rollers 513 and 514, and the path switching flapper 510 is arranged at the downstream of the depression roller 514. The path switching flapper 511 peels the sheet wound around the buffer roller 505 from the buffer roller 505 and selectively guides the sheet to a non-sorting path 521 or a sorting path 522.

The path switching flapper 510 selectively guides the sheet to the sorting path 522 or a buffer path 523. When guiding the sheet to the sorting path 522, the path switching flapper 510 peels the sheet wound around the buffer roller 505 from the buffer roller 505 and guides the sheet to the sorting path 522. When guiding the sheet to the buffer path 523, the path switching flapper 523 guides the sheet to the buffer path 523 under the condition where the sheet is wound around the buffer roller 505.

When guiding the sheet to the non-sorting path 521, the path switching flapper 511 is operated. Then, the sheet guided to the non-sorting path 521 is ejected to a sample tray 701 by a conveying roller pair 509. A conveyance sensor 533 for detecting passage of a sheet is arranged on route of the non-sorting path 521. When guiding the sheet to the buffer path 523, the path switching flappers 510 and 511 are not operated. As a result of this, the sheet is sent to the buffer path 523 while being wound around the buffer roller 505. A conveyance sensor 532 for detecting a sheet on the buffer path 523 is arranged on route of the buffer path 523.

When the sheet is guided to the sorting path 522, the path switching flapper 511 is not operated and the path switching flapper 510 is operated. The sheet is peeled from the buffer roller 505 by the path switching flapper 510, and is guided to the sorting path 522.

The sheets guided to the sorting path 522 are sequentially ejected to a processing tray (an intermediate tray) 630 by conveyance roller pairs 506 and 507, and are stacked as a bundle. The sheet bundle on the processing tray 630 is pulled back to the rear end side in the sheet conveyance direction by a knurled belt 661 and a puddle 660 that are driven in synchronizing with the conveying roller pair 507. The pulled-back sheet bundle stops when coming to a stopper (stopper member) 631 at the rear end side in the sheet conveyance direction (the downstream in the pull back direction).

Figure 5A:
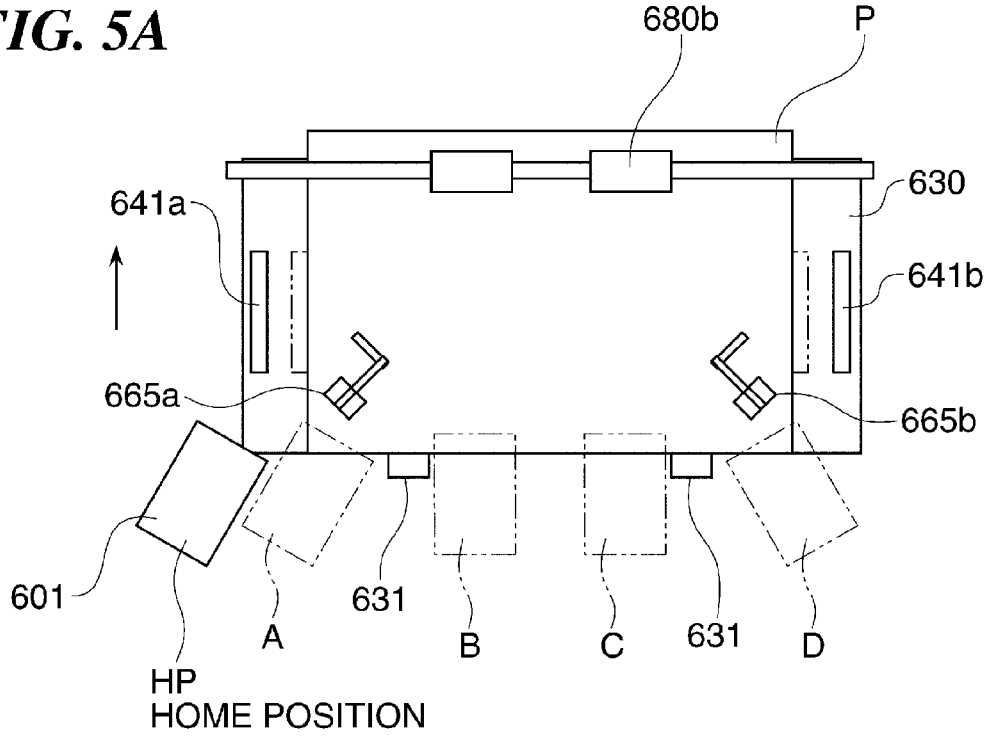
FIG. 5A is a plan view showing a process on a processing tray shown in FIG. 4 when viewed from over the processing tray.
Figure 5B:
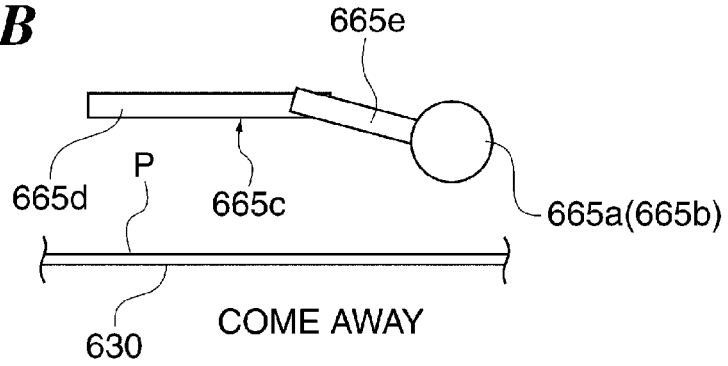
FIG. 5B is a side view showing a state where an alignment roller with which the processing tray is provided comes away from a sheet.
Figure 5C:
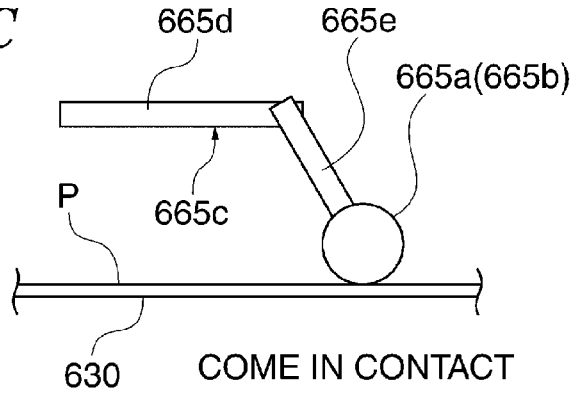
FIG. 5C is a side view showing a state where the alignment roller with which the processing tray is provided contacts the sheet.

FIG. 5A, through FIG. 5C are views showing the processes on the processing tray 630 shown in FIG. 4. FIG. 5A is a plan view of the processing tray 630 viewed from the upper point, and FIG. 5B is a view showing a state where an alignment roller 665*a* or 665*b* with which the processing tray 630 is provided comes away from the sheet. FIG. 5C is a view showing a state where the alignment roller 665*a* or 665*b* with which the processing tray 630 is provided comes in contact with the sheet.

On the processing tray 630, a pair of alignment members (alignment plates) 641*a* and 641*b* are arranged. These alignment members 641*a* and 641*b* move in the width direction that intersects (for example, perpendicularly intersects) the conveyance direction of the sheet P shown by a solid line arrow in FIG. 5A. An alignment process is applied to the sheet P stacked on the processing tray 630 (a sheet stacking unit) by movements of the first alignment member 641*a* and the second alignment member 641*b*. After applying the alignment process, a staple process etc. are applied to the sheet bundle if needed, and then, the sheet bundle is ejected to a stack tray 700 by ejection rollers 680*a* and 680*b*.

That is, the first alignment member 641*a* is arranged at the processing tray 630 so as to be movable in the direction that intersects the sheet conveyance direction, and is pushed against a first sheet side that is one side of two sides of the sheet parallel to the sheet conveyance direction (a first pushing process).

The second alignment member 641*b* is arranged at the processing tray 630 so as to be movable in the direction that intersects the sheet conveyance direction, and is pushed against a second sheet side that is the other side of two sides of the sheet parallel to the sheet conveyance direction (a second pushing process).

As shown in FIG. 5A, the alignment rollers 665*a* and 665*b* (a pushing unit) are arranged on the processing tray 630. These alignment rollers 665*a* and 665*b* are located at a lower left corner and a lower right corner of the downstream side in the sheet conveyance direction, respectively, when the sheet is stacked on the processing tray 630.

These alignment rollers 665*a* and 665*b* are supported by arm units 665*c* as shown in FIG. 5B, and the alignment rollers 665*a* and 665*b* are arranged so that their rotating shafts (not shown) intersect the sheet conveyance direction. The arm unit 665*c* is provided with first and second arms 665*d* and 665*e*, which are linked by a pin member (not shown) etc.

The second arm 665*e* is rotatable to the first arm 665*d*. The alignment roller 665*a* (665*b*) can come in contact with or away from the sheet P by driving the second arm 665*e* (see FIG. 5B and FIG. 5C).

As mentioned above, the alignment rollers 665*a* and 665*b* come in contact with or away from the sheet P on the processing tray 630 by driving the arm unit 665*c*. Then, the sheet P is aligned in the conveyance direction by selectively bringing the alignment rollers 665*a* and 665*b* in contact with or away from the sheet P and by driving the alignment rollers 665*a* and 665*b* corresponding to an alignment mode, as mentioned later.

The mechanism will be described with reference to FIG. 4 again. The ejection roller 680*b* is supported by a rocking guide 650. The ejection roller 680*b* rocks according to the motion of the rocking guide 650, and contacts the uppermost sheet on the processing tray 630. When the ejection roller 680*b* is in contact with the uppermost sheet on the processing tray 630, the ejection roller 680*b* collaborates with the ejection roller 680*a* to eject the sheet bundle on the processing tray 630 toward the stack tray 700.

A projectable tray 670 is arranged below the processing tray 630. When a sheet is stacked on the processing tray 630, the projectable tray 670 is projected upward from a slit (not shown) formed on the processing tray 630. This prevents hanging down and poor return of the sheet P conveyed by the conveying roller pair 507, and improves the accuracy of alignment of the sheet on the processing tray 630.

The stack tray 700 is arranged so that rise and fall are possible. A sheet level detection sensor 540 (FIG. 6) detects the stack tray 700 or the uppermost surface of the sheet bundle ejected to the stack tray 700. Then, the tray lifting motor is driven according to the detection result of the sheet level detection sensor 540, and is controlled so that the above-mentioned uppermost surface matches a predetermined position. It should be noted that the sample tray 701 is fixed to the position shown in FIG. 4 and cannot go up and down in contrast to the stack tray 700.

A staple process (a binding process) is performed by a stapler 601. When the staple process is performed, the sheet bundle stacked on the processing tray 630 is bound at the rear end in the sheet conveyance direction.

As shown in FIG. 5A, the stapler 601 is movable in the width direction that intersects perpendicularly with the conveyance direction along one side of the processing tray 630, and moves to the binding position that was set up by a user from a home position as mentioned later.

For example, when a user selects an upper right corner binding or a lower left corner binding of the sheet bundle, the stapler 601 moves to the position shown by the symbol "A" in FIG. 5A. When a user selects an upper left corner binding or a lower right corner binding of the sheet bundle, the stapler 601 moves to the position shown by the symbol "D". When a user selects a double binding, the stapler 601 moves to the positions shown by the symbols "B" and "C" by turns, and the staple process will be performed.

Figure 6:
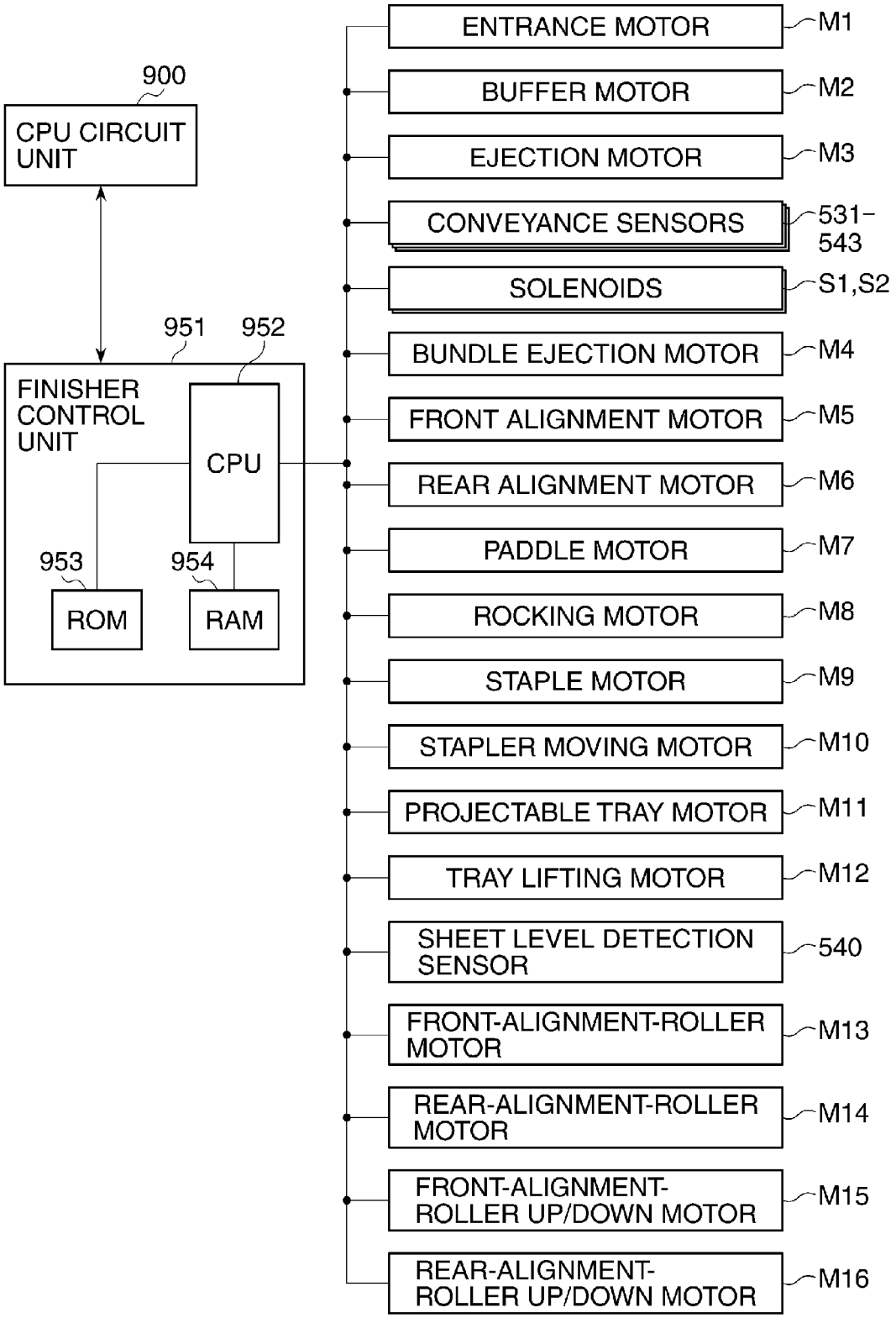
FIG. 6 is a block diagram showing a finisher control unit that controls the finisher shown in FIG. 4.

FIG. 6 is a block diagram showing the finisher control unit 951 that controls the finisher 500 shown in FIG. 4.

The finisher control unit 951 is provided with a CPU 952, a ROM 953, and a RAM 954. The finisher control unit 951 communicates job information, a sheet passing notice, etc. with the CPU circuit unit 900 with which the image forming apparatus 10 is provided using a communication IC (not shown). Then, the CPU 952 executes various programs stored in the ROM 953 based on instructions from the CPU circuit unit 900, and controls the finisher 500.

The finisher 500 is provided with an entrance motor M1, a buffer motor M2, an ejection motor M3, solenoids S1 and S2, and the conveyance sensors 531 through 534. The finisher 500 is further provided with a bundle ejection motor M4, a front alignment motor M5, a rear alignment motor M6, a paddle motor M7, a rocking motor M8, a staple motor M9, a stapler moving motor M10, a projectable tray motor M11, a tray lifting motor M12, the sheet level detection sensor 540, a front-alignment-roller motor M13, a rear-alignment-roller motor M14, a front-alignment-roller up/down motor M15, and a rear-alignment-roller up/down motor M16. These motors and sensors are connected to the CPU 952, and the CPU 952 controls the motors according to the detection results of the sensors.

The entrance motor M1 drives the entrance roller pair 502 and the conveying roller pairs 503 and 504. The buffer motor M2 drives the buffer roller 505. The solenoid S1 drives the path switching flapper 511. The solenoid S2 drives the path switching flapper 510.

The ejection motor M3 drives the conveying roller pairs 506 and 507. The paddle motor M7 drives the paddle 660. The front alignment motor M5 and the rear alignment motor M6 drive the alignment members 641*a* and 641*b* in the direction that intersects perpendicularly to the sheet conveyance direction, respectively. The front-alignment-roller motor M13 and the rear-alignment-roller motor M14 drive the alignment rollers 665*a* and 665*b*, respectively. Then, the front-alignment-roller up/down motor M15 and the rear-alignment-roller up/down motor M16 drive the arm units for the alignment rollers 665*a* and 665*b*, respectively.

The bundle ejection motor M4 drives the ejection roller pair 680, and the rocking motor M8 drives the rocking guide 650. The projectable tray 670 is driven by the projectable tray motor M11, and the stack tray 700 is driven by the tray lifting motor M12. This tray lifting motor M12 is driven according to the detection result of the sheet level detection sensor 540.

The stapler 601 is driven by the staple motor M9, and performs the binding process. The stapler 601 is driven in the direction that intersects perpendicularly with the conveyance direction along one side of the processing tray 630 by the stapler moving motor M10.

Next, the process in the finisher 500 in the sorting mode will be described.

Figure 7A:
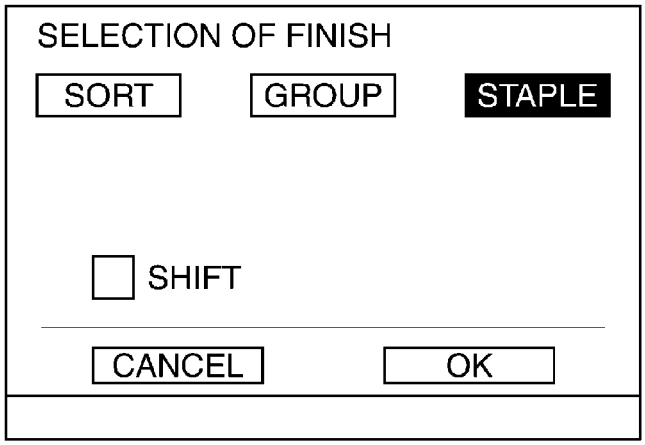
FIG. 7A is a view showing a finish menu selection screen displayed on the operation display units shown in FIG. 3.
Figure 7B:
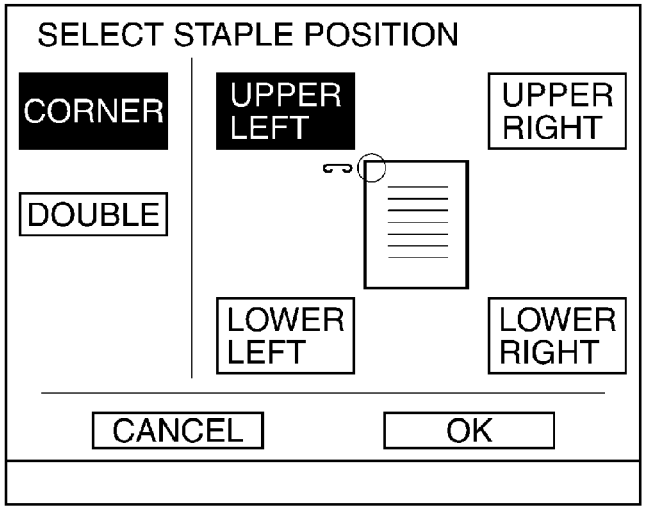
FIG. 7B is a view showing a state where corner binding is selected in a staple setting screen displayed on the operation display unit shown in FIG. 3.
Figure 7C:
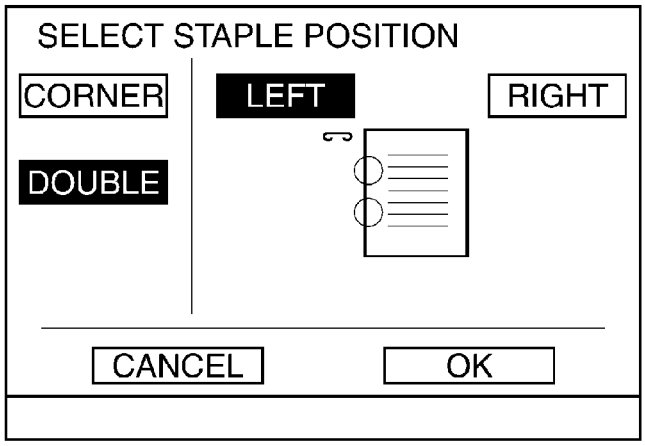
FIG. 7C is a view showing a state where double binding is selected in a staple setting screen displayed on the operation display unit shown in FIG. 3.

FIG. 7A through FIG. 7C are views showing screens displayed on the operation display units 400 shown in FIG. 3. FIG. 7A is a view showing a finish menu selection screen, and FIG. 7B is a view showing a state where corner binding is selected in a staple setting screen. FIG. 7C is a view showing a state where double binding is selected in the staple setting screen.

If a user selects the "FINISH" key in the initial screen (FIG. 3) displayed on the operation display unit 400, the finish menu selection screen shown in FIG. 7A is displayed on the display unit 420. When the user pushes an OK key while selecting a "SORT" key in the finish menu selection screen, the CPU circuit unit 900 sets up the sorting mode.

When a print job is supplied after the sorting mode was set up, the CPU 901 notifies the CPU 952 of the finisher control unit 951 of print job information, such as a sheet size and sorting-mode setting information. Hereafter, a case for printing a plurality of copies of results each of which consists of three sheets will be described.

Figure 8A:
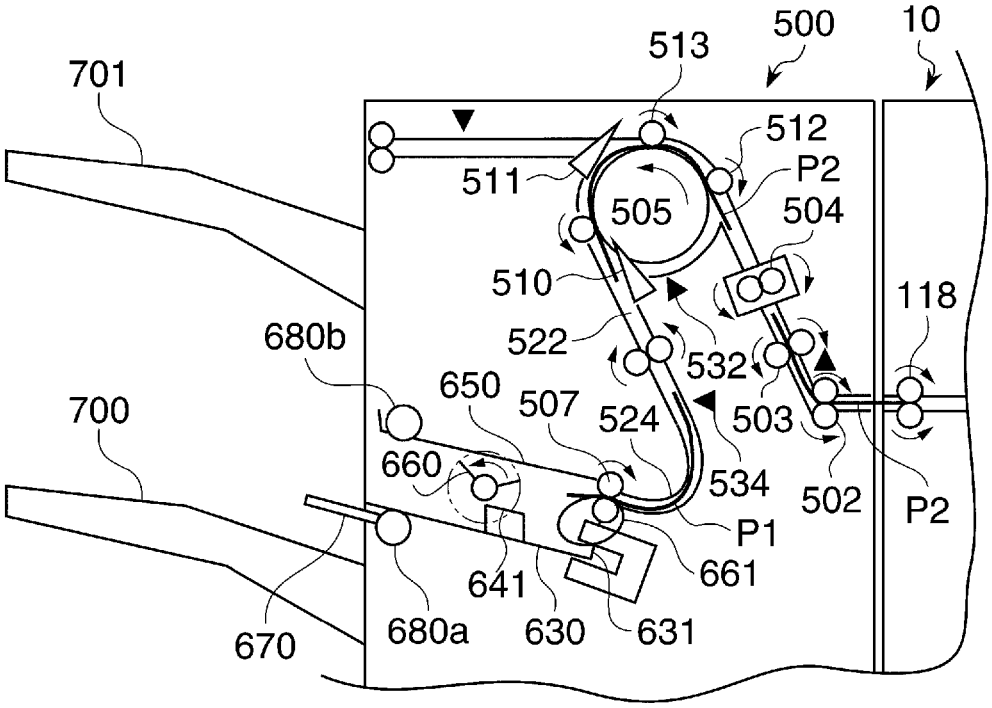
FIG. 8A is a view showing a part of a process performed by the finisher shown in FIG. 4 in a sorting mode until a sheet is conveyed to the processing tray.
Figure 8B:
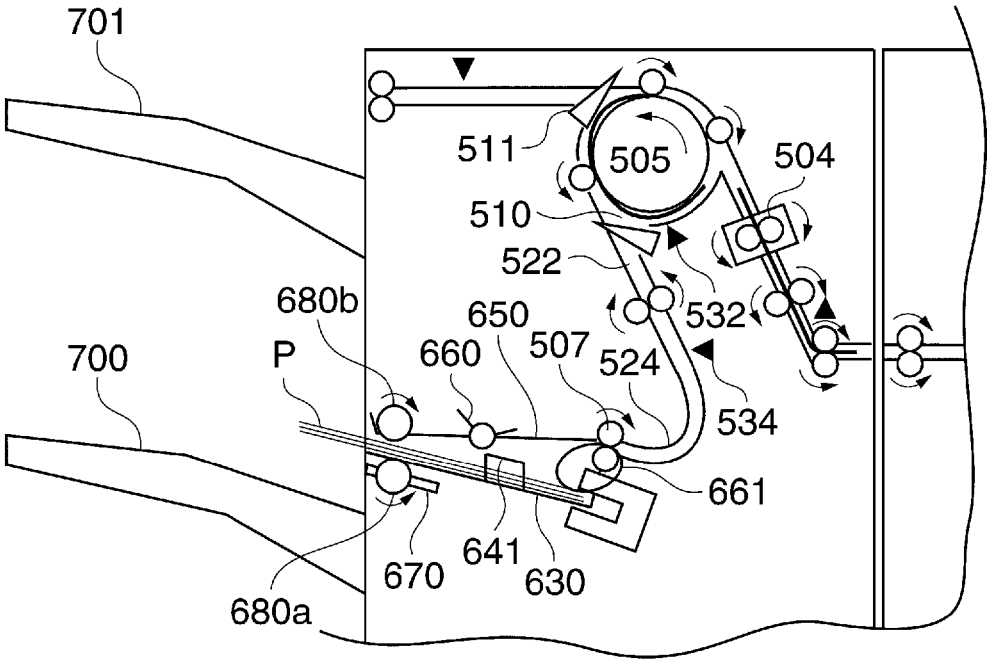
FIG. 8B is a view showing an alignment process performed by the finisher shown in FIG. 4 in the sorting mode.
Figure 8C:
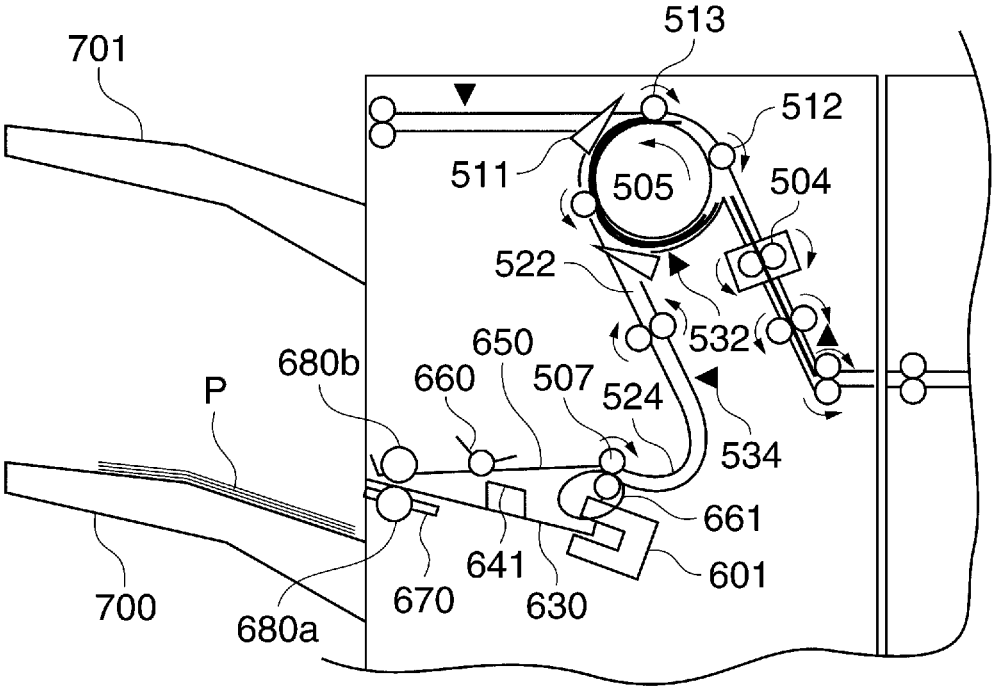
FIG. 8C is a view showing a state where a sheet bundle is ejected to a stack tray during the process performed by the finisher shown in FIG. 4 in the sorting mode.

FIG. 8A through FIG. 8C are views showing a process performed by the finisher 500 shown in FIG. 4 in the sorting mode. Then, FIG. 8A is a view showing a process until a sheet is conveyed to the processing tray 630, and FIG. 8B is a view showing the alignment process. FIG. 8C is a view showing a state where a sheet bundle was ejected to the stack tray 700.

When the sorting mode is set up, the CPU 901 of the CPU circuit unit 900 notifies the CPU 952 of the finisher control unit 951 of starting to pass the sheet P at the time of ejecting the sheet P from the image forming apparatus 10 to the finisher 500.

When receiving the notice of starting to pass the sheet P, the CPU 952 drives the entrance motor M1 and the buffer motor M2 to rotate the entrance roller pair 502, the conveying roller pairs 503 and 504, and the buffer roller 505. Accordingly, the sheet P ejected from the image forming apparatus 10 is taken into the finisher 500, and is conveyed.

The path switching flappers 510 and 511 stop at the positions shown in FIG. 8A, and the sheet P1 is guided to the sorting path 522. The sheet P1 guided to the sorting path 522 is ejected to the processing tray 630 by the conveyance roller pairs 506 and 507.

The CPU 952 determines that the sheet P1 has been ejected to the processing tray 630, when time predetermined by a built-in timer elapses after detecting the rear end of the sheet P1 by the conveyance sensor 534 and the sheet P1 is conveyed by a predetermined distance. The sheet P1 ejected to the processing tray 630 moves toward the stopper 631 by gravity on the processing tray 630. This movement of the sheet P1 is supported by support members, such as the paddle 660 and the knurled belt 661.

When the rear end of the sheet P1 comes in contact with the stopper 631 and the sheet P1 stops, the sheet P1 is adjusted by the alignment member 641. Similarly, the sheets P2 and P3 are sequentially stacked on the processing tray 630.

When the sheets P1, P2, and P3 (a sheet bundle) are stacked on the processing tray 630, the CPU 952 drives the rocking motor M8 to bring down the rocking guide 650. Accordingly, the sheet bundle P is pinched by the ejection rollers 680*a* and 680*b*, and is ejected to the stack tray 700. One-set sheet bundle is stacked in page order so that the top page is arranged in the lowermost position with the image formation side down. Then, the next set sheet bundle is stacked on the stack tray 700 (see FIG. 8C).

Although the above-mentioned example describes the case where one set consists of three sheets, the number of sheets that comprise one set is not limited to this case. In the sorting mode, the CPU 952 controls to eject a sheet bundle when a predetermined number N (referred to as the bundle ejection sheet number) of sheets are stacked on the processing tray 630. For example, when the bundle ejection sheet number N is "5", whenever five sheets are stacked on the processing tray 630, these sheets are ejected to the stack tray 700 as a sheet bundle. Accordingly, when the number of sheets of one set is "10", bundle ejection operations are performed two times until one set of sheets are ejected.

Next, the process for a second sheet bundle while the first sheet bundle P is taken and ejected will be described.

Figure 9A:
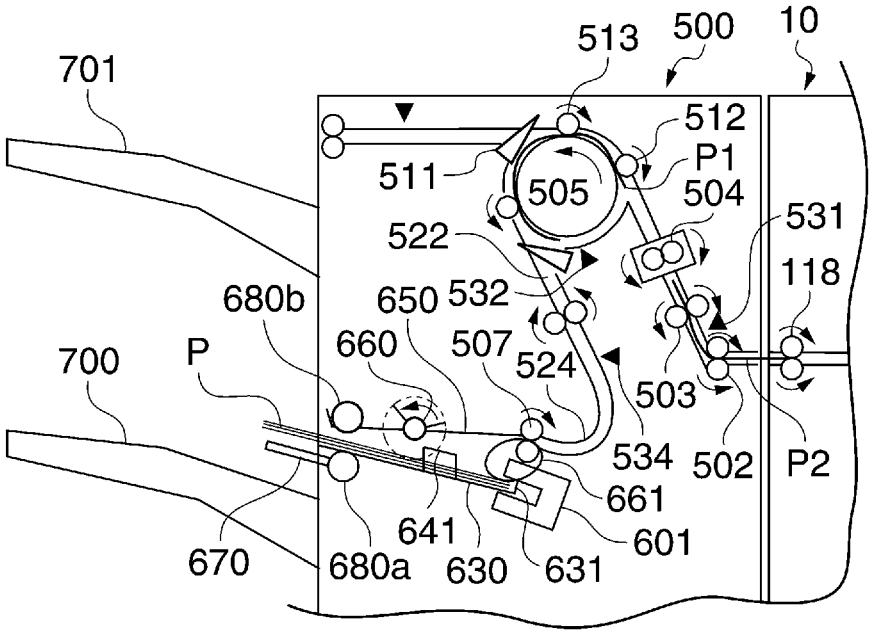
FIG. 9A is a view showing a state where a first sheet of a second sheet bundle is wound around a buffer roller while a first sheet bundle is taken and ejected in the finisher shown in FIG. 4.
Figure 9B:
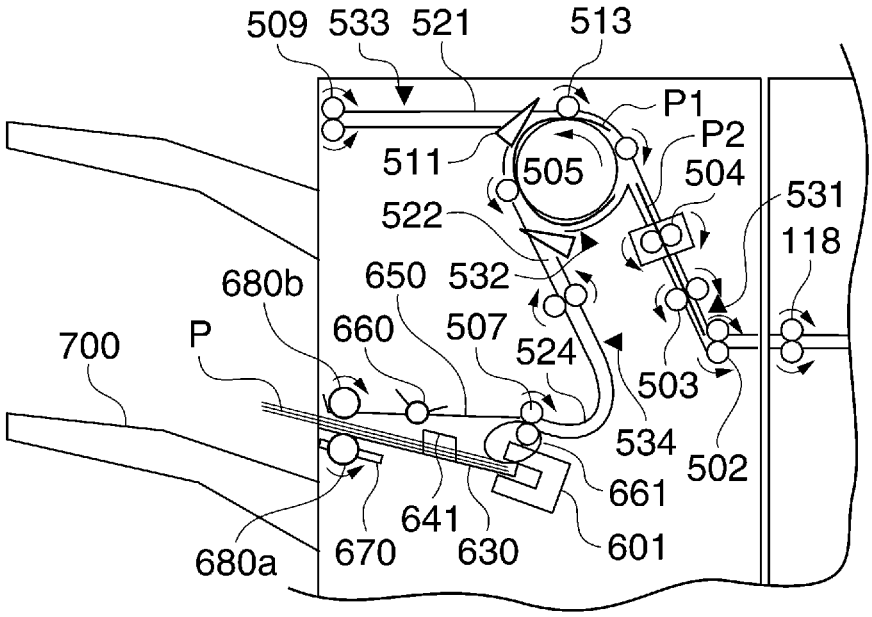
FIG. 9B is a view showing a state where a second sheet of the second sheet bundle starts to overlap with the first sheet that is wound around the buffer roller while the first sheet bundle is taken and ejected in the finisher shown in FIG. 4.
Figure 9C:
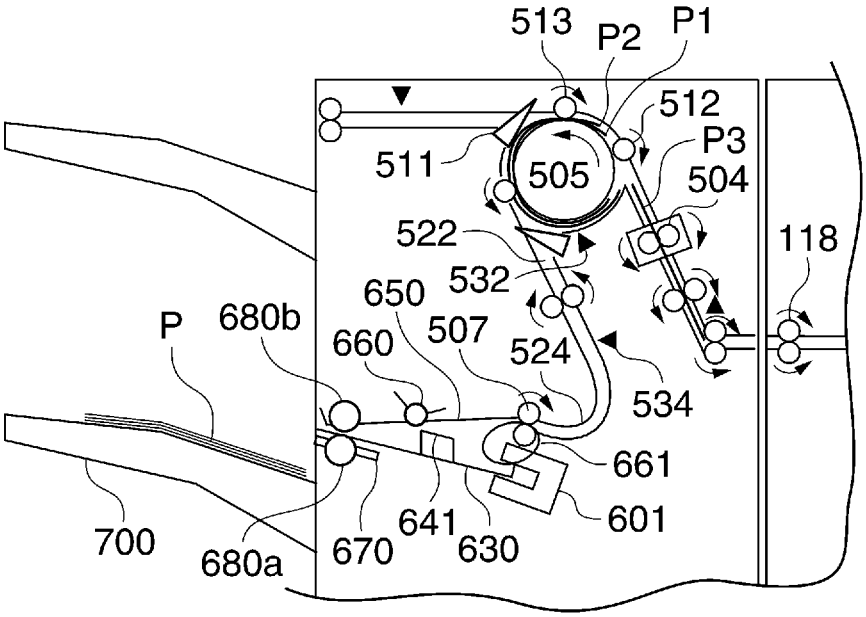
FIG. 9C is a view showing a state where a third sheet of the second sheet bundle starts to overlap with the first and second sheets that are wound around the buffer roller while the first sheet bundle is taken and ejected in the finisher shown in FIG. 4.
Figure 9D:
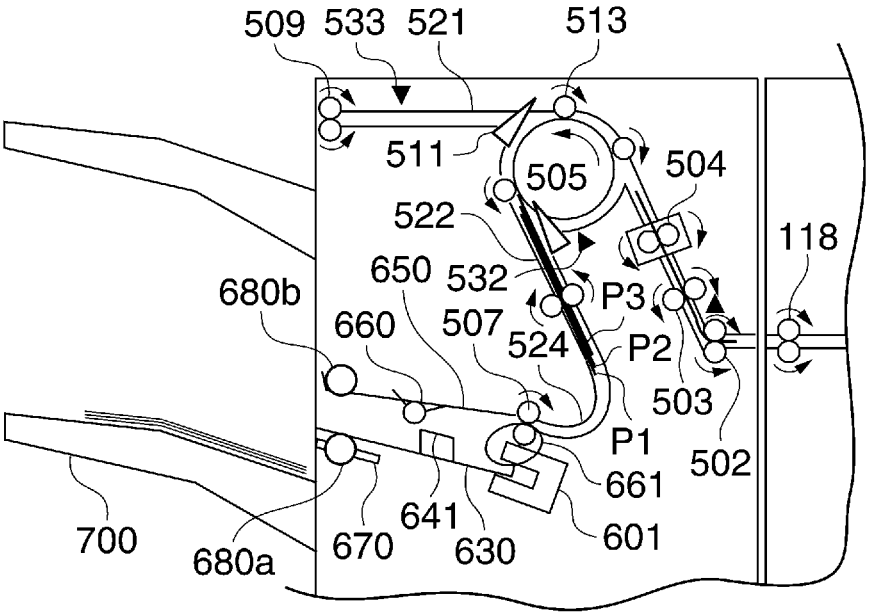
FIG. 9D is a view showing a state where the second sheet bundle was conveyed to a sorting path while the first sheet bundle is taken and ejected in the finisher shown in FIG. 4.

FIG. 9A through FIG. 9D are views showing the process for the second sheet bundle while the first sheet bundle P is taken and ejected in the finisher 500 shown in FIG. 4. Then, FIG. 9A is a view showing a state where a first sheet is wound around the buffer roller 505, and FIG. 9B is a view showing a state where a second sheet starts to overlap with the first sheet that is wound around the buffer roller 505. FIG. 9C is a view showing a state where a third sheet starts to overlap with the first and second sheets that are wound around the buffer roller 505, and FIG. 9D is a view showing a state where the sheet bundle was conveyed to the sorting path 522.

After the last sheet of the first sheet bundle P is stacked on the processing tray 630, the first sheet P1 of the second sheet bundle is wound around the buffer roller 505 by the operation of the path switching flapper 510 (see FIG. 9A). Then, the CPU 952 stops the buffer roller 505, when the sheet P1 is conveyed by a predetermined distance from the conveyance sensor 532.

When the front end of the sheet P2 of the second sheet bundle proceeds by a predetermined distance from the conveyance sensor 531, the CPU 952 drives the buffer roller 505 so as to start laying the sheet P2 over the sheet P1 (see FIG. 9B). Then, the CPU 952 controls the path switching flapper 510 to convey the sheets P1 and P2 to the buffer path 523 again, and starts laying the following third sheet over the sheets P1 and P2 (see FIG. 9B).

When the sheets P1 through P3 are overlapped as mentioned above, the CPU 952 controls the path switching flapper 510 so as to convey the three sheets to the sorting path 522 as a sheet bundle P (see FIG. 9D). At this time, the bundle ejecting operation for the sheet bundle P stacked on the processing tray 630 has been finished, and the processing tray 630 is ready to receive a new sheet bundle ejected. Accordingly, the second sheet bundle is ejected to the processing tray 630 through the sorting path 522.

Fourth and later sheets of the second sheet bundle would be ejected to the processing tray 630 through the sorting path 522 like the sheets of the first sheet bundle. A third sheet bundle will be processed in the same manner as that for the second sheet bundle, and then, the sheet bundles of the set number will be stacked on the stack tray 700.

Next, the process in the finisher 500 in the staple mode will be described.

When a user selects the "FINISH" key in the initial screen (FIG. 3) displayed on the operation display unit 400, the finish menu selection screen shown in FIG. 7A is displayed on the display unit 420. When the user presses the "STAPLE" key in the finish menu selection screen, the CPU circuit unit 900 displays the staple setting screen shown in FIG. 7B or FIG. 7C on the display unit 420.

The user can select the binding mode from among the corner binding and the double binding through the staple setting screen. FIG. 7B shows the state where the corner binding mode is selected in the staple setting screen. In the corner binding mode, the staple process is applied to any one of the four corners of the sheet bundle. Accordingly, the user selects one from among "UPPER LEFT", "LOWER LEFT", "UPPER RIGHT", and "LOWER RIGHT" in the staple setting screen. The "UPPER LEFT" is selected in the example shown in FIG. 7B.

FIG. 7C shows the state where the double binding mode is selected in the staple setting screen. In the double binding mode, the staple process is applied to two points of any one of two sides along the selected side. Accordingly, the user selects one from "RIGHT" and "LEFT". The "LEFT" is selected in the example shown in FIG. 7C.

Incidentally, the finisher 500 is able to apply the binding process to only the rear end in the sheet bundle in the conveyance direction. For this reason, the CPU circuit unit 900 changes the orientation of the image in the top-and-bottom direction at the time of image formation according to the binding mode and the binding position.

For example, when the corner binding mode with the binding position of "UPPER LEFT" or "LOWER LEFT" is selected in the staple process, the CPU circuit unit 900 controls so as to output the read image (input image) without changing the orientation (the rear side of the image forming apparatus 10 becomes the top side of the image in FIG. 1).

When the binding position is "UPPER LEFT", the stapler 601 moves to the position indicated by the symbol "D" in FIG. 5 and performs the binding process. When the binding position is "LOWER LEFT", the stapler 601 moves to the position indicated by the symbol "A" in FIG. 5 and performs the binding process.

When the corner binding mode with the binding position of "UPPER RIGHT" or "LOWER RIGHT" is selected, the CPU circuit unit 900 changes the orientation of the image upside down (i.e., rotates image by 180 degrees). When the binding position is "UPPER RIGHT", the stapler 601 moves to the position indicated by the symbol "A" in FIG. 5 and performs the binding process. When the binding position is "LOWER RIGHT", the stapler 601 moves to the position indicated by the symbol "D" in FIG. 5 and performs the binding process.

Similarly, when the double binding mode with the binding side "LEFT" is selected in the staple process, the CPU circuit unit 900 controls so as to output the inputted image without changing the orientation. When the binding side is "RIGHT", the CPU circuit unit 900 rotates the input image by 180 degrees. Then, the stapler 601 moves to the positions indicated by the symbols "B" and "C" in FIG. 5 and performs the binding processes, respectively.

Figure 10A:
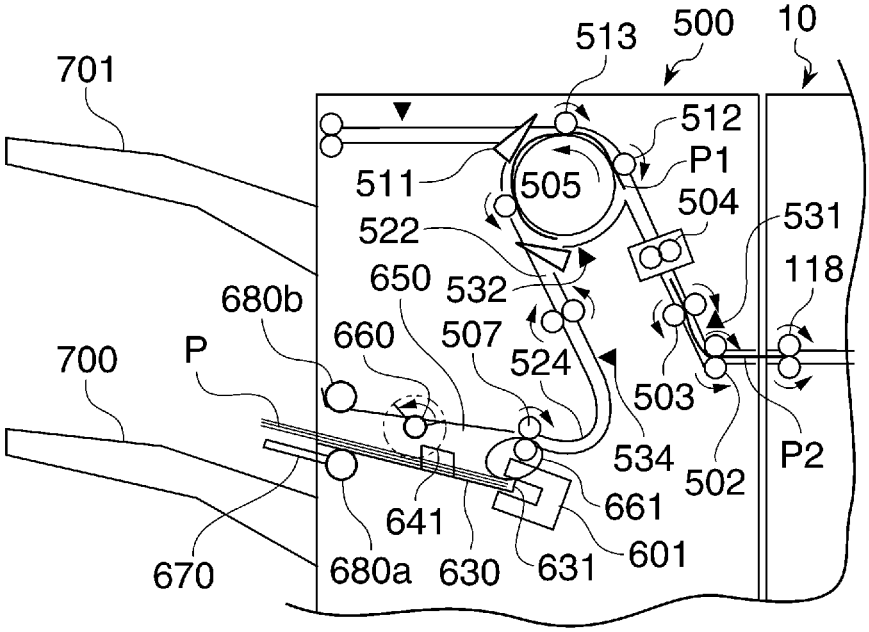
FIG. 10A is a view showing a state where sheets of the first sheet bundle are ejected to the processing tray during the process performed by the finisher shown in FIG. 4 in a staple mode.
Figure 10B:
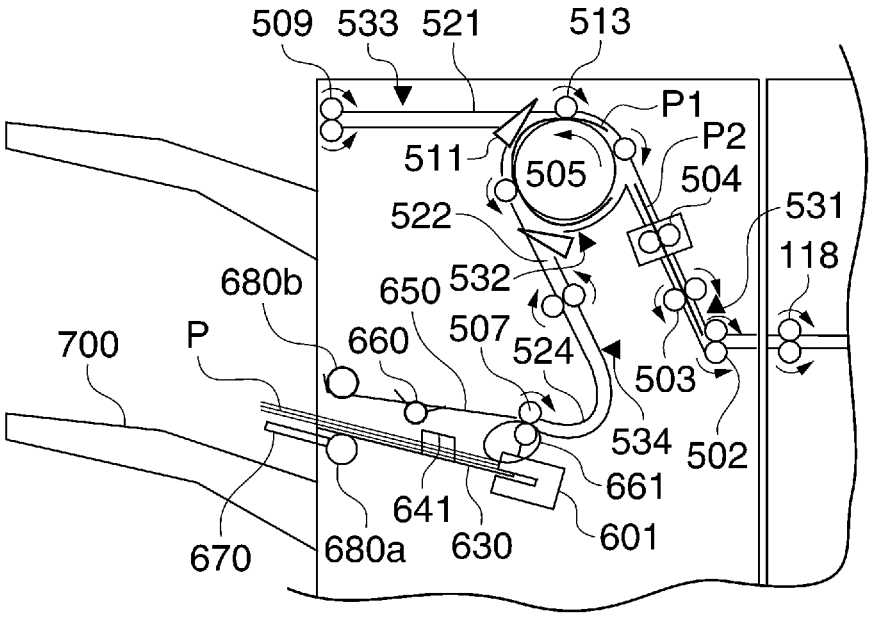
FIG. 10B is a view showing a state where a staple process is applied to the first sheet bundle during the process performed by the finisher shown in FIG. 4 in the staple mode.
Figure 10C:
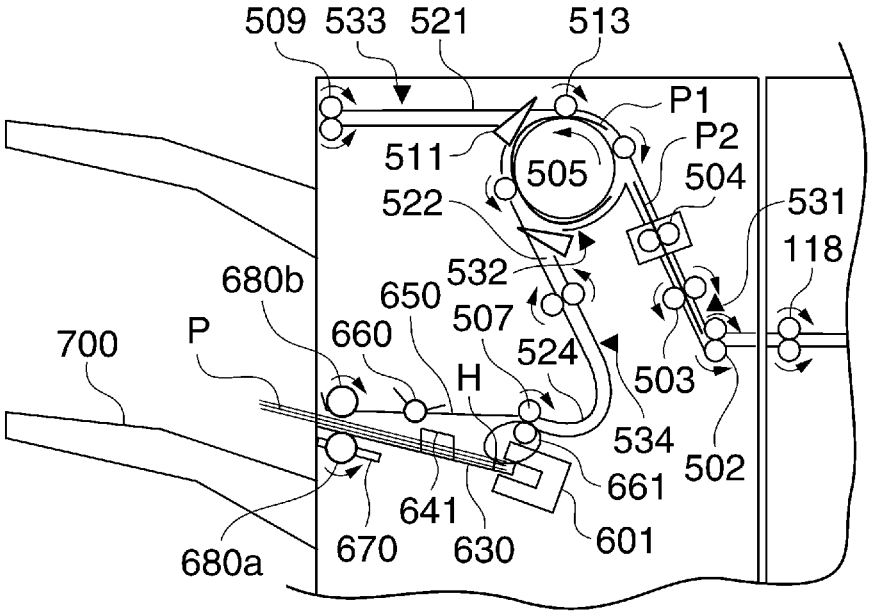
FIG. 10C is a view showing a state where the first sheet bundle to which the staple process was applied starts to be ejected during the process performed by the finisher shown in FIG. 4 in the staple mode.
Figure 10D:
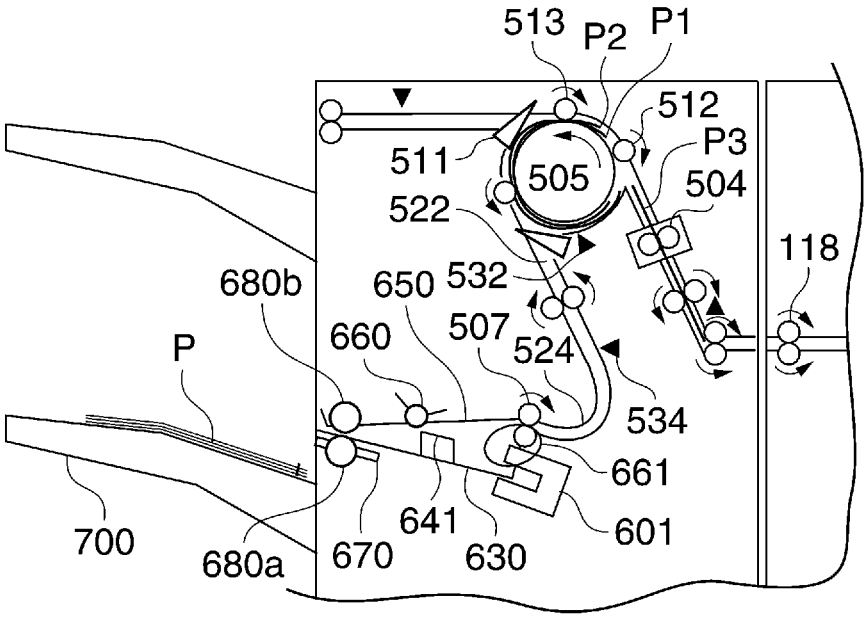
FIG. 10D is a view showing a state where the first sheet bundle was ejected during the process performed by the finisher shown in FIG. 4 in the staple mode.

FIG. 10A through FIG. 10D are views showing a process performed by the finisher 500 shown in FIG. 4 in the staple mode. FIG. 10A is a view showing a state where the sheets of the first sheet bundle are ejected to the processing tray 630. FIG. 10B is a view showing a state where the staple process is applied to the first sheet bundle. FIG. 10C is a view showing a state where the first sheet bundle to which the staple process was applied starts to be ejected. FIG. 10D is a view showing a state where the first sheet bundle was ejected.

When a user sets the staple mode, the CPU 901 of the CPU circuit unit 900 notifies the CPU 952 of the finisher control unit 951 that the staple mode was selected in the same manner as the case of setting the sorting mode. As a result of this, the CPU 952 controls the finisher 500 to stack sheets on the processing tray 630 sequentially like the sorting mode mentioned above (see FIG. 10A).

When all the sheets that comprise one booklet have been stacked on the processing tray 630, the alignment members 641*a* and 641*b* apply the alignment process to the stacked sheets. And then, the CPU 952 drives the staple motor M9 to bind the sheet bundle by the stapler 601 (FIG. 10B). As a result of this, the sheet bundle P is bound by a staple needle H at the rear end in the conveyance direction as shown in FIG. 10C.

When the binding process by the stapler 601 is completed, the CPU 952 drives the rocking motor M8 to bring down the rocking guide 650 (FIG. 10C). As a result of this, the ejection rollers 680*a* and 680*b* pinch and eject the sheet bundle P. Then, the sheet bundle P is ejected to the stack tray 700 (FIG. 10D).

As mentioned above, the sheets conveyed from the image forming apparatus 10 to the finisher 500 are different in a basis weight or a surface nature (coated paper etc.) in some cases even if their sizes are identical. It is known that the degree of shrinkage of a sheet in a fixing process varies depending on the type of the sheet.

On the other hand, actual sizes (actual measurement) of sheets of some manufacturers or brands are often different from nominal sizes. In addition, there may be lot-to-lot unevenness or sheet-to-sheet unevenness in sheets of the same brand.

Figure 11A:
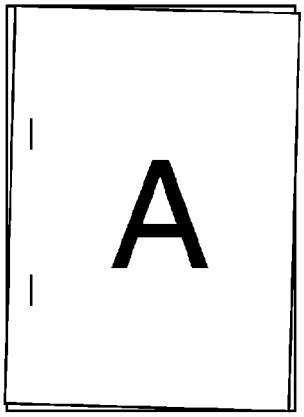
FIG. 11A is a view showing a state of the double binding when the staple process is applied to sheets with variation in size.
Figure 11B:
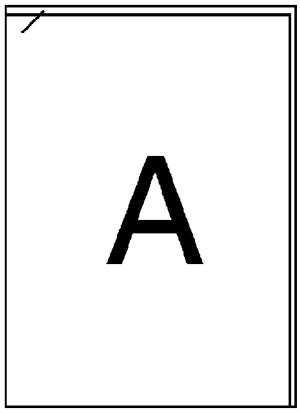
FIG. 11B is a view showing a state of corner binding when the staple process is applied to sheets with variation in size.

FIG. 11A and FIG. 11B are views showing binding states of sheets to which the staple process is applied when the sizes of sheets are uneven. FIG. 11A is a view showing the double binding, and FIG. 11B is a view showing the corner binding.

In the staple mode mentioned above, if one sheet bundle includes sheets that are identical in nominal size but different in actual size, it is difficult to align the sheets with sufficient accuracy only by the alignment process by the alignment members 641*a* and 641*b*.

As a result, the staple process will be performed in the state where the sheets are not aligned accurately, as shown in FIG. 11A and FIG. 11B. In the example shown in FIG. 11A, the sheet of smaller size is rotated slightly and is deviated from the other sheets. In the example shown in FIG. 11B, the staple needle comes off the sheet of smaller size.

In order to avoid such a phenomenon, the finisher 500 shown in FIG. 4 has a mode to align sheets with reference to the front side of the processing tray 630 (a front side alignment mode) and a mode to align sheets with reference to the rear side (a rear side alignment mode) as alignment modes in addition to a usual alignment mode (a normal alignment mode). Here, the front side means the near side when viewing the finisher 500 in FIG. 4, and the rear side means the far side when viewing the finisher 500 in FIG. 4. That is, in the example shown in FIG. 5, the alignment member 641*a* is in the front side, and the alignment member 641*b* is in the rear side. In the normal alignment mode, sheets are aligned by the alignment members 641*a* and 641*b* without using the alignment rollers 665*a* and 665*b*.

The finisher control unit 951 changes the above-mentioned alignment modes according to the sheet type and the post-processing mode information (staple-mode information) that are included in the job information transmitted from CPU circuit unit 900 at the time of starting the print job. For example, in the corner binding mode, the CPU 952 selects the alignment mode so as to align two sides of a sheet bundle between which a corner to be bound is positioned. In the double binding mode, the CPU 952 selects the alignment mode so as to align the bottom side of a sheet bundle after finishing.

Figure 12A:
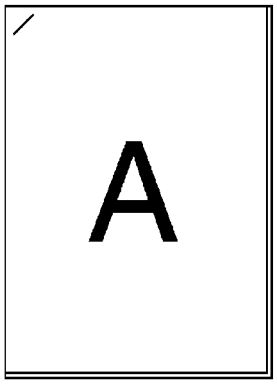
FIG. 12A is a view showing a first example of sheets bound at a corner (corner binding) when an alignment process was applied according to a sheet type and a post-processing mode information in the finisher shown in FIG. 4.
Figure 12B:
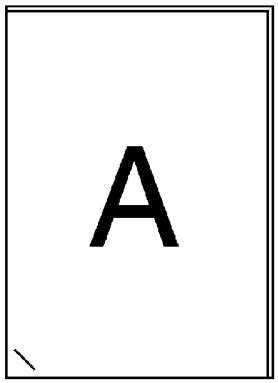
FIG. 12B is a view showing a second example of sheets bound at a corner (corner binding) when the alignment process was applied according to a sheet type and a post-processing mode information in the finisher shown in FIG. 4.
Figure 12C:
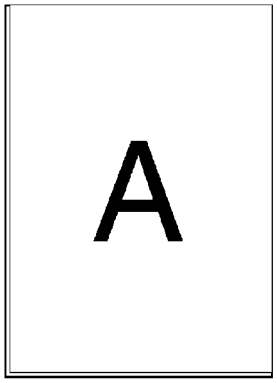
FIG. 12C is a view showing a third example of sheets bound at a corner (corner binding) when the alignment process was applied according to a sheet type and a post-processing mode information in the finisher shown in FIG. 4.
Figure 12D:
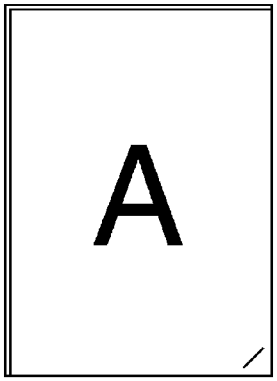
FIG. 12D is a view showing a fourth example of sheets bound at a corner (corner binding) when the alignment process was applied according to a sheet type and a post-processing mode information in the finisher shown in FIG. 4.
Figure 12E:
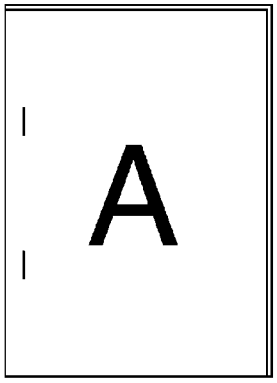
FIG. 12E is a view showing a first example of sheets bound at tow points (double binding) when the alignment process was applied according to a sheet type and a post-processing mode information in the finisher shown in FIG. 4.
Figure 12F:
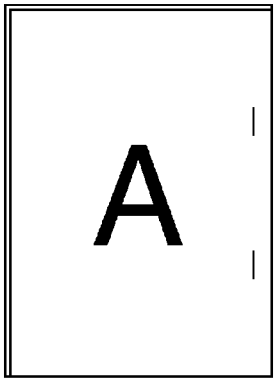
FIG. 12F is a view showing a second example of sheets bound at tow points (double binding) when the alignment process was applied according to a sheet type and a post-processing mode information in the finisher shown in FIG. 4.

FIG. 12A through FIG. 12F are views showing sheet bundles to which the alignment processes are applied by the finisher 500 shown in FIG. 4 according to the sheet type and the post-processing mode information. FIG. 12A through FIG. 12F show the states where single-sided printed sheets are viewed from the printed side. FIG. 12A is a view showing a first example of the corner binding. FIG. 12B is a view showing a second example of the corner binding. FIG. 12C is a view showing a third example of the corner binding. FIG. 12D is a view showing a fourth example of the corner binding. FIG. 12E is a view showing a first example of the double binding. FIG. 12F is a view showing a second example of the double binding.

FIG. 12A shows the sheet bundle of which the upper left corner is bound when the rear side alignment mode is selected as the alignment mode. FIG. 12B shows the sheet bundle of which the lower left corner is bound when the front side alignment mode is selected as the alignment mode. FIG. 12C shows the sheet bundle of which the upper right corner is bound when the front side alignment mode is selected as the alignment mode. FIG. 12D shows the sheet bundle of which the lower right corner is bound when the rear side alignment mode is selected as the alignment mode.

FIG. 12E shows the sheet bundle of which the two points in the left side are bound when the front side alignment mode is selected as the alignment mode. FIG. 12F shows the sheet bundle of which the two points in the right side are bound when the rear side alignment mode is selected as the alignment mode.

It should be noted that when the left side of the sheet bundle is stapled as shown in FIG. 12A, FIG. 12B, and FIG. 12E, an image is formed so that the left side of the sheet bundle becomes the rear end in the conveyance direction within the finisher 500. When the right side of the sheet bundle is stapled as shown in FIG. 12C, FIG. 12D, and FIG. 12F, an image is formed so that the right side of the sheet bundle becomes the rear end in the conveyance direction within the finisher 500.

The setting process of the alignment mode by the finisher control unit 951 shown in FIG. 6 will be described.

Figure 13:
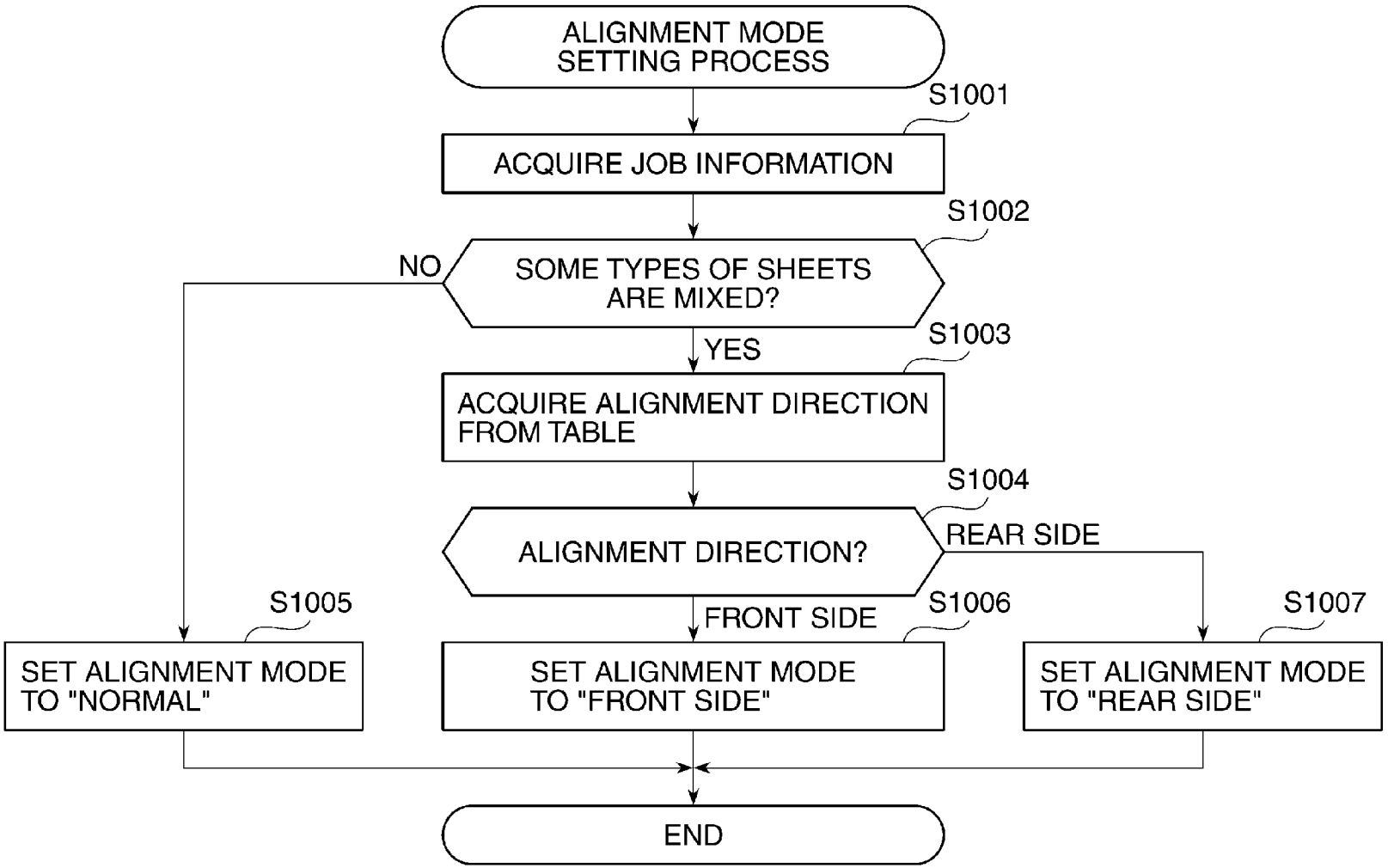
FIG. 13 is a flowchart showing an alignment mode setting process performed by a finisher control unit shown in FIG. 6.

FIG. 13 is a flowchart showing an alignment mode setting process performed by the finisher control unit 951 shown in FIG. 6. FIG. 14 is a view showing an example of an alignment direction table stored in the ROM 953 shown in FIG. 6. It should be noted that the CPU 952 executes the process concerning the flowchart shown in FIG. 13.

When starting a print job, the CPU 901 transmits the job information to the finisher control unit 951. The job information concerned includes at least the post-processing mode (staple mode) that shows which of the corner binding and the double binding is selected, the post-processing position that shows the binding position in the corner binding or the binding positions in the double binding, and the sheet type information (a sheet size, a basis weight, a shape, grain running, a surface nature, a manufacturing maker, a production lot, etc.). It should be noted that the "shape" shows normal paper, pre-punch paper, index paper or the like, and the "surface nature" shows the existence or nonexistence of surface coat. The sheet type information does not necessarily include all pieces of information mentioned above, and required information can be set up arbitrarily.

When acquiring the job information, the CPU 952 saves the job information concerned into the RAM 954 (S1001). Then, the CPU 952 determines whether a plurality of types of sheets mixed are ejected to the processing tray 630 based on the job information (S1002). When the plurality of types of sheets are not mixed (NO in the step S1002), the CPU 952 sets the alignment mode as the normal alignment mode, and saves it to the RAM 954 (S1005). Then, the CPU 952 finishes the alignment mode setting process. The state where the plurality of types of sheets are not mixed corresponds to the state where the types of all the sheets are identical.

Then, the CPU 952 acquires the post-processing mode and the post-processing position in the job information from the RAM 954, and acquires the alignment direction of the sheets with reference to the alignment direction table shown in FIG. 14 (S1003).

The alignment direction table shown in FIG. 14 is beforehand stored in the ROM 953, and defines the standby position of the stapler 601 and the alignment direction corresponding to the post-processing mode and the post-processing position. Here, the alignment direction shows either of the front side alignment mode or the rear side alignment mode described in FIG. 12A through FIG. 12F. The CPU 952 can acquire the standby position of the stapler 601 and the alignment direction corresponding to the post-processing mode and the post-processing position by referring to the alignment direction table shown in FIG. 14. It should be noted that the symbols "A" through "D" that show the standby positions in the alignment direction table correspond to the positions of the stapler 601 shown in FIG. 5, respectively.

Next, the CPU 952 performs a determination process for determining whether the alignment direction is a front side or a rear side (S1004). When the alignment direction is a front side (front side in the step S1004), the CPU 952 sets the alignment mode as the front side alignment mode (S1006), and finishes the alignment mode setting process.

On the other hand, when the alignment direction is a rear side (rear side in the step S1004), the CPU 952 sets the alignment mode as the rear side alignment mode (S1007), and finishes the alignment mode setting process. It should be noted that the established alignment mode is saved in the RAM 954.

Next, the staple process performed by the finisher control unit 951 shown in FIG. 6 will be described.

Figure 15:
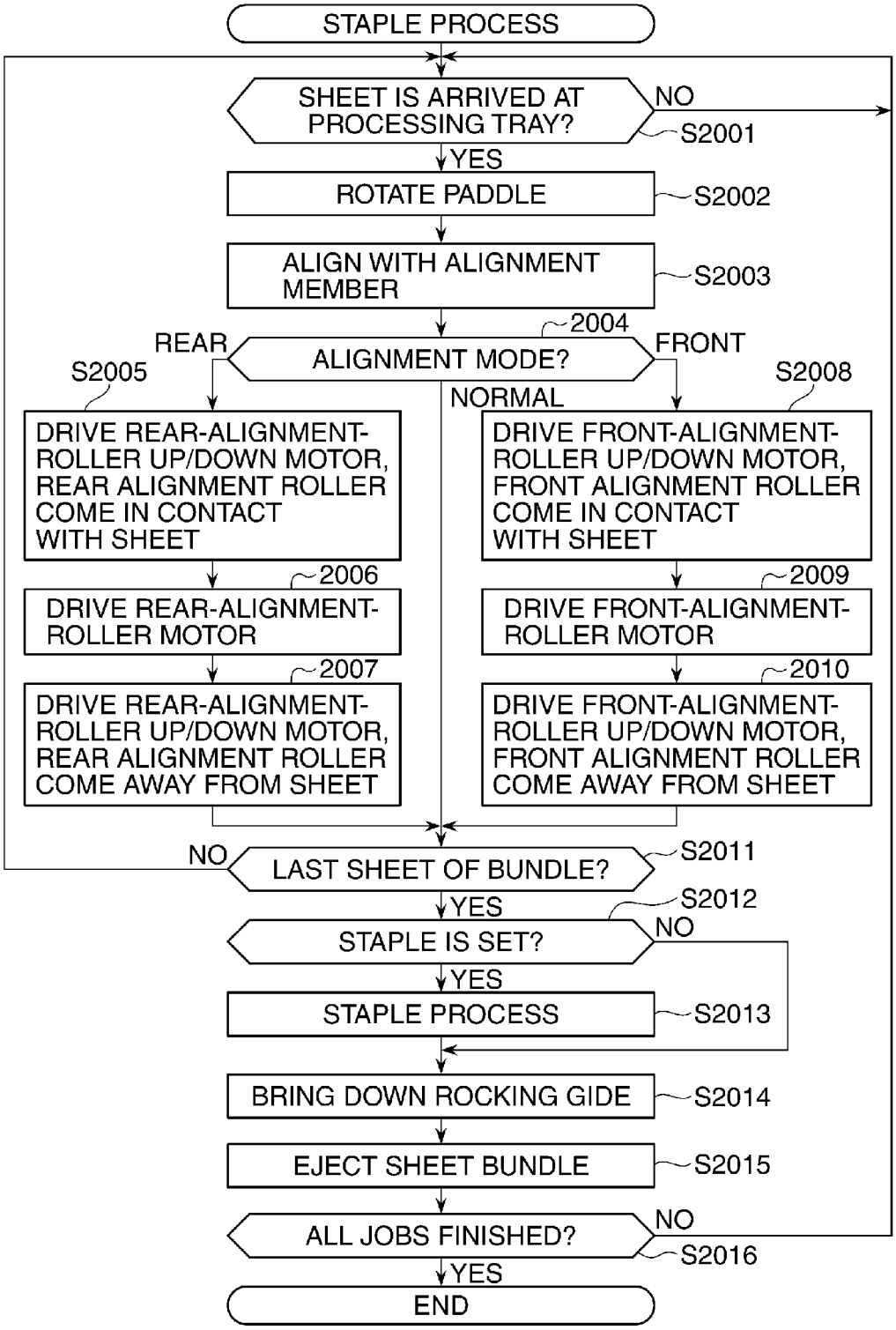
FIG. 15 is a flowchart showing the staple process performed by the finisher control unit shown in FIG. 6.

FIG. 15 is a flowchart showing the staple process performed by the finisher control unit 951 shown in FIG. 6. It should be noted that the process according to the flowchart shown in FIG. 15 is performed by the CPU 952.

Figure 16A:
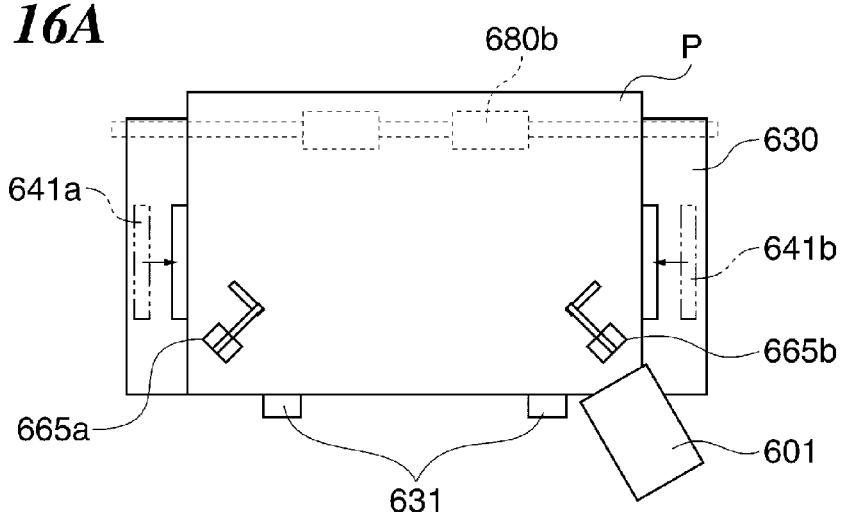
FIG. 16A is a plan view showing a state where sheets are stacked on the processing tray in the staple process shown in FIG. 5.
Figure 16B:
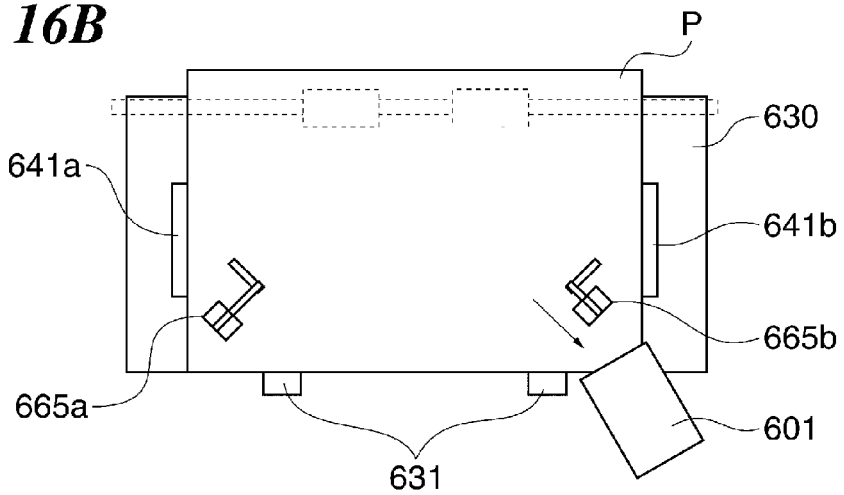
FIG. 16B is a view showing the alignment process in the staple process shown in FIG. 5.
Figure 16C:
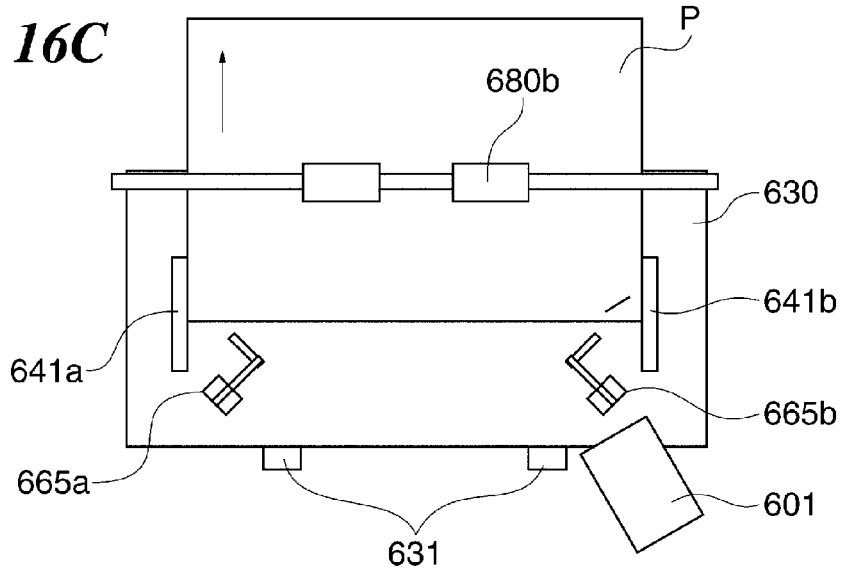
FIG. 16C is a view showing an ejection process after the staple process shown in FIG. 5.

FIG. 16A through FIG. 16C are views showing the staple process on the processing tray 630 shown in FIG. 5. Then, FIG. 16A is a view showing a state where a sheet is stacked on the processing tray 630, and FIG. 16B is a view showing the alignment process. FIG. 16C is a view showing an ejection of sheets after the staple process.

When a print job is started, the CPU 952 monitors the ejection of a sheet to the processing tray 630 in response to the detection result by the conveyance sensor 534 (S2001). When a sheet is not ejected (NO in the step S2001), the CPU 952 performs another process like the sheet conveyance control.

When a sheet is ejected to the processing tray 630 (YES in the step S2001), the CPU 952 drives the paddle motor M7 to rotate the puddle 660 (S2002). Next, the CPU 952 drives the front alignment motor M5 and the rear alignment motor M6 to perform the alignment process by the alignment members 641*a* and 641*b* (S2003), and stacks the sheets on the processing tray 630 (see FIG. 16A).

The example shown in FIG. 16A shows the stacking of the sheets on the processing tray 630 in the case where the post-processing mode is the corner binding and the post-processing position is the lower right. In this case, the stapler 601 moves to the standby position "D" shown in FIG. 5.

Next, the CPU 952 acquires the alignment mode established by the process shown in FIG. 13 from the RAM 952, and determines which alignment mode was established (S2004).

When the established alignment mode is the rear side alignment mode (rear side in the step S2004), the CPU 952 drives the rear-alignment-roller up/down motor M16 so that the back alignment roller 665*b* comes in contact with the sheet P (S2005). The CPU 952 drives the rear-alignment-roller motor M14 (S2006). When the rear-alignment-roller motor M14 is driven, the rear alignment roller 665*b* rotates and pushes the sheet in the direction shown by a solid line arrow in FIG. 16B (the lower rightward direction).

Then, the CPU 952 stops the rear-alignment-roller motor M14, and drives the rear-alignment-roller up/down motor M16 again so that the rear alignment roller 665*b* comes away from the sheet P (S2007). Thereby, the sheet P moves to the alignment member 641*b* and the stopper 631, and is aligned in the sheet conveyance direction and the direction that intersects the sheet conveyance direction.

When the established alignment mode is the front side alignment mode (front side in the step S2004), the CPU 952 drives the front-alignment-roller up/down motor M15 so that the front alignment roller 665*a* comes in contact with the sheet P (S2008) in the same manner. The CPU 952 drives the front-alignment-roller motor M13 (S2009). When the front-alignment-roller motor M13 is driven, the front alignment roller 665*a* rotates and pushes the sheet in the lower leftward direction.

Then, the CPU 952 stops the front-alignment-roller motor M13, and drives the front-alignment-roller up/down motor M15 again so that the front alignment roller 665*a* comes away from the sheet P (S2010).

Next, the CPU 952 determines whether the last sheet of the first sheet bundle is stacked on the processing tray 630 (S2011). It should be noted that the CPU 952 proceeds with the process to the step S2011 when the established alignment mode is the normal alignment mode (normal in the step S2004). When determining that the last sheet of the first sheet bundle is not stacked on the processing tray 630 (NO in the step S2011), the CPU 952 returns the process to the step S2001.

When determining that the last sheet of the first sheet bundle is stacked on the processing tray 630 (YES in the step S2011), the CPU 952 determines whether the staple mode has been set with reference to the job information saved in the RAM 954 (S2012). When the staple mode has been set (YES in the step S2012), the CPU 952 drives the staple motor M9 to apply the staple process using the stapler 601 to the sheet bundle P that is stacked on the processing tray 630 (S2013).

Next, the CPU 952 drives the rocking motor M8 so as to bring down the rocking guide 650 (S2014). It should be noted that the CPU 952 proceeds with the process to the step S2014 when the staple mode has not been set (NO in the step S2012). Further, the CPU 952 drives the bundle ejection motor M4 to rotate the ejection roller pair 680 so as to eject the sheet bundle P to the stack tray 700 as shown in FIG. 16C (S2015).

Then, the CPU 952 determines whether all the print jobs finished (S2016). When not all the print jobs finished (NO in the step S2016), the CPU 952 returns the process to the step S2001. On the other hand, when all the print jobs finished (YES in the step S2016), the CPU 952 finishes the process shown in FIG. 15.

The process shown in FIG. 15 employs three alignment modes (the normal alignment mode, the front side alignment mode, and the rear side alignment mode) and selects either of the front side alignment mode or the rear side alignment mode when a plurality of types of sheets are included in a sheet bundle. Alternatively, the process may employ only the front side alignment mode and the rear side alignment mode. In such a case, the alignment process will be performed in one of the front side alignment mode and the rear side alignment mode.

The above-mentioned embodiment performs the alignment process using the front alignment roller 665*a* or the rear alignment roller 665*b* in order to align a sheet with a reference surface (the alignment member 641*a* or 641*b*). A member like the puddle 660 may be used instead of the roller, for example. The alignment process may be also performed with the paddle 660 that pulls back a sheet by changing the direction (angle) of the paddle 660 according to the alignment mode.

Moreover, a roller that moves a sheet in a direction perpendicular to the alignment members 641*a* and 641*b* may be used. A sheet is moved to an alignment member used as the reference surface by rotating the roller in forward or reverse direction selectively.

In addition, although the staple process was mentioned as the example in the post-processing mode, a sorting process, a punching process, a pasting bookbinding process, a tape bookbinding process, a saddle bookbinding process, etc. can be performed in the post-processing mode. For example, the alignment process will be performed so that the "bottom" side serves as the reference surface in the sorting process, the punching process, and the bookbinding process.

Thus, the first embodiment of the present invention can accurately perform the alignment process of a sheet bundle even if the sheet bundle includes a plurality of types (a sheet size etc.) of sheets, and can set up the reference position depending on the finish. As a result, even if a plurality of types of sheets are mixed in one booklet (sheet bundle), the optimal alignment process can be performed according to the post-processing mode, and the result aligned with sufficient accuracy can be acquired.

Subsequently, a finisher according to a second embodiment of the present invention will be described. It should be noted that the configuration of the finisher in the second embodiment is the same as that of the finisher in the first embodiment.

Figure 17A:
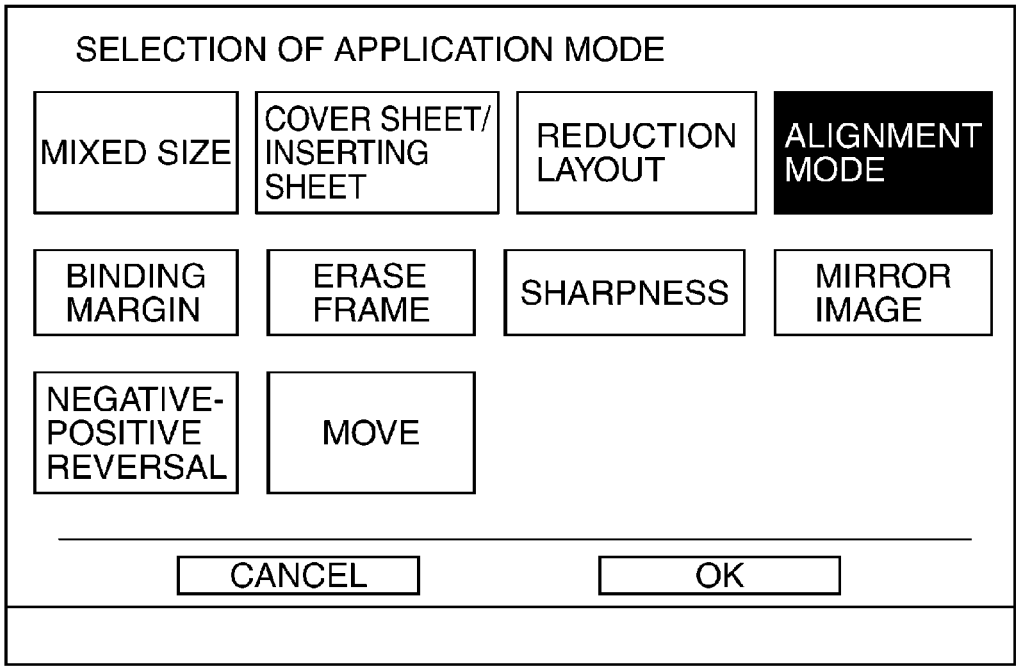
FIG. 17A is a view showing an application mode selection screen displayed on the operation display unit in a finisher according to a second embodiment of the present invention.
Figure 17B:
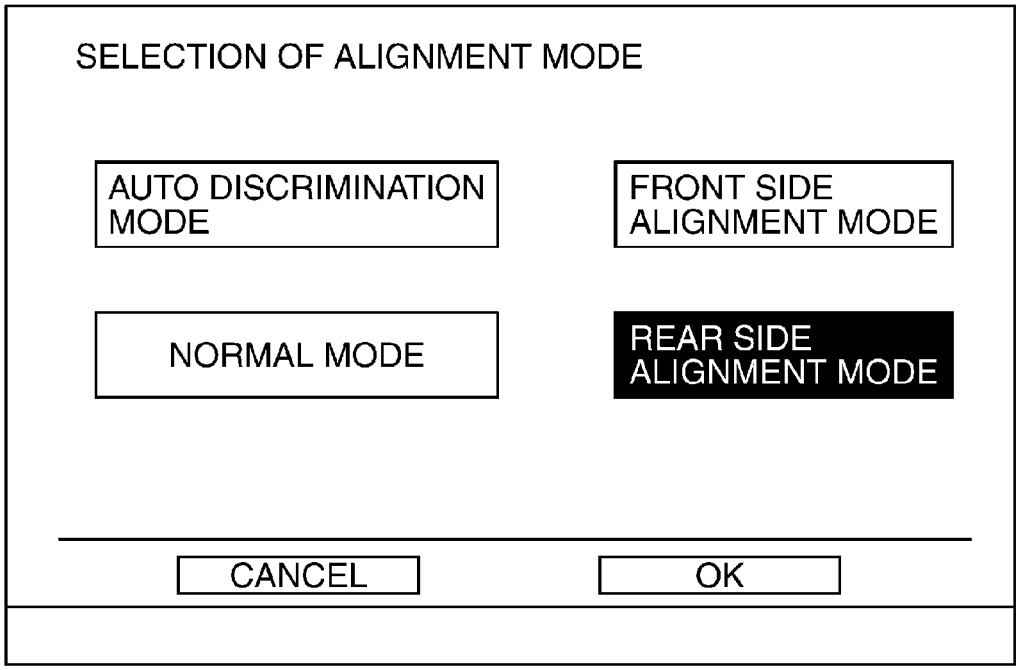
FIG. 17B is a view showing an alignment mode selection screen displayed on the operation display unit in the finisher according to the second embodiment of the present invention.

FIG. 17A and FIG. 17B are views showing alignment mode selection screens displayed on the operation display unit 400 in the finisher according to the second embodiment. Then, FIG. 17A shows an application mode selection screen, and FIG. 17B shows an alignment mode selection screen.

When a user depresses the "APPLICATION MODE" button shown in FIG. 3 on the operation display unit (a designation unit) 400, the CPU circuit unit 900 displays the application mode selection screen shown in FIG. 17A on the display unit 420. When the user selects an "ALIGNMENT MODE" button in the application mode selection screen, the CPU circuit unit 900 displays the alignment mode selection screen shown in FIG. 17B on the display unit 420.

In the alignment mode selection screen shown in FIG. 17B, an "AUTO DISCRIMINATION MODE" is selected as an initial state. In the auto detection mode, the staple process described by the first embodiment is performed. When one of the "NORMAL MODE" (normal alignment mode), the "FRONT SIDE ALIGNMENT MODE", and the "REAR SIDE ALIGNMENT MODE" is selected, the alignment mode is not selected according to the post-processing mode as described in the first embodiment. That is, when one of the "NORMAL MODE", the "FRONT SIDE ALIGNMENT MODE", and the "REAR SIDE ALIGNMENT MODE" is selected, the process is performed in the selected alignment mode. It means that the user designated a reference side as a designated reference side.

It should be noted that the CPU 901 transmits the information (alignment mode information) concerning the alignment mode selected in the alignment mode selection screen to the CPU 952 in addition to the job information when the print job starts.

Subsequently, an alignment mode selection process in the finisher 500 according to the second embodiment will be described.

Figure 18:
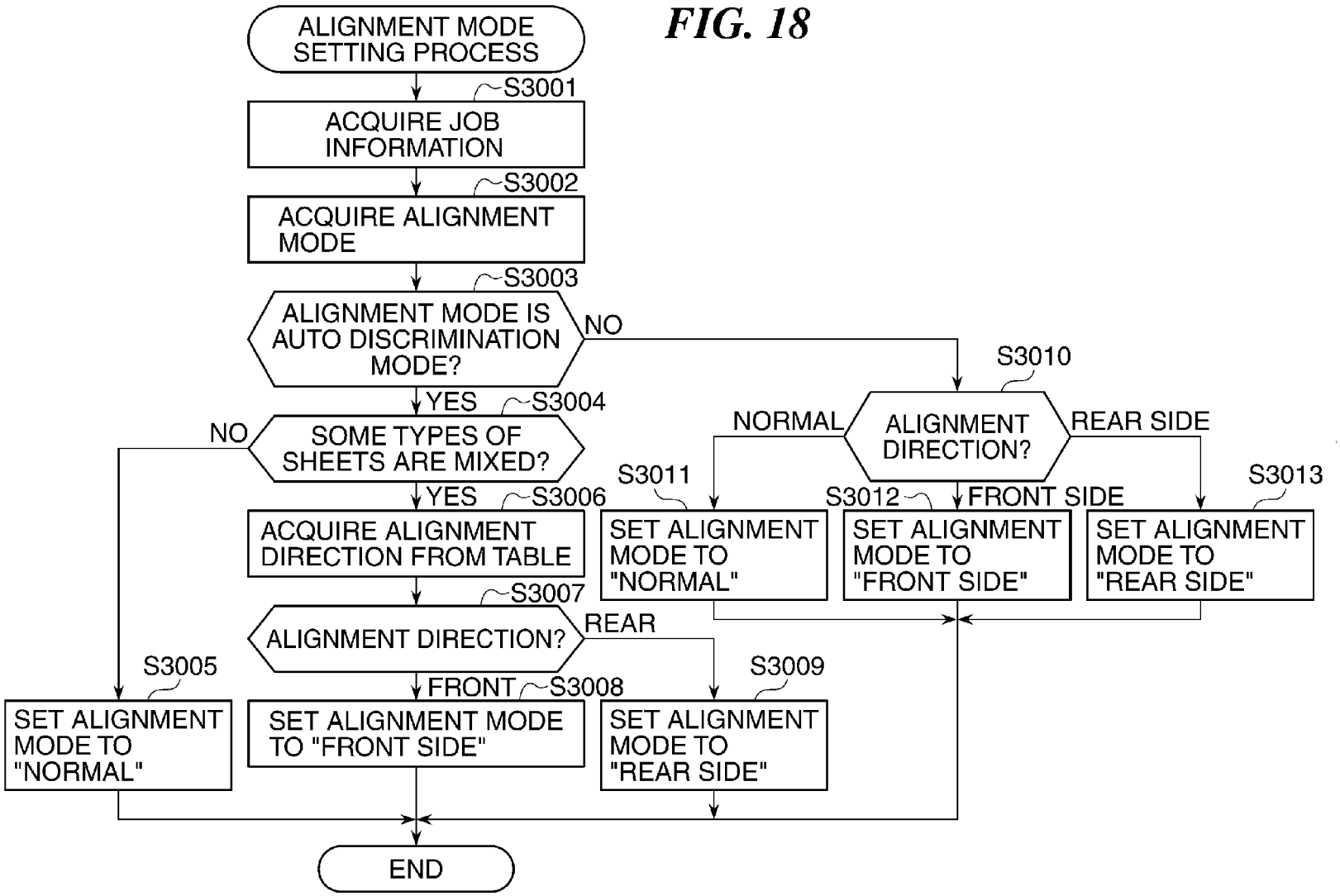
FIG. 18 is a flowchart showing an alignment mode selection process in the finisher according to the second embodiment of the present invention.

FIG. 18 is a flowchart showing the alignment mode selection process in the finisher 500 according to the second embodiment When starting a print job, the CPU 901 transmits the job information to the finisher control unit 951. The job information concerned includes at least the post-processing mode (staple mode) that shows which of the corner binding and the double binding is selected, the post-processing position that shows the binding position in the corner binding or the binding positions in the double binding, and the sheet type information (a sheet size, a basis weight, a shape, grain running, a surface nature, etc.). When acquiring the job information, the CPU 952 saves the job information concerned into the RAM 954 (S3001).

Next, the CPU 952 acquires the alignment mode information from the CPU 901 (S3002), and saves the alignment mode information concerned in the RAM 954. This alignment mode information shows the alignment mode that was selected by the user in the alignment mode selection screen shown in FIG. 17B.

The CPU 952 determines whether the alignment mode that was selected by the user is the auto discrimination mode with reference to the alignment mode information saved in the RAM 954 (S3003). When the alignment mode that was selected by the user is the auto discrimination mode (YES in the step S3003), the CPU 952 determines whether a plurality of types of sheets are mixed in a sheet bundle ejected to the processing tray 630 based on the job information (S3004). When the plurality of types of sheets are not mixed (NO in the step S3004), the CPU 952 sets the alignment mode as the normal alignment mode, and saves it to the RAM 954 (S3005). Then, the CPU 952 finishes the alignment mode setting process.

When determining that the plurality of types of sheets are mixed (YES in the step S3004), the CPU 952 acquires the post-processing mode and the post-processing position in the job information from the RAM 954, and acquires the alignment direction of the sheets with reference to the alignment direction table shown in FIG. 14 (S3006).

Next, the CPU 952 determines whether the alignment direction is a front side or a rear side (S3007). When the alignment direction is the front side (front side in the step S3007), the CPU 952 sets the alignment mode as the front side alignment mode (S3008), and finishes the alignment mode setting process.

On the other hand, when the alignment direction is the rear side (rear side in the step S3007), the CPU 952 sets the alignment mode as the rear side alignment mode (S3009), and finishes the alignment mode setting process. It should be noted that the established alignment mode is saved in the RAM 954.

When the alignment mode that is selected by the user is not the auto discrimination mode (NO in the step S3003), the CPU 952 discriminates which of the normal alignment mode, the front side alignment mode, and the rear side alignment mode is the alignment mode selected (S3010). When the alignment mode that is selected by the user is the normal mode (normal in the step S3010), the CPU 952 sets up the normal mode as the alignment mode (S3011), and finishes the alignment mode setting process.

When the alignment mode that is selected by the user is the front side alignment mode (front side in the step S3010), the CPU 952 sets the alignment mode as the front side alignment mode (S3012), and finishes the alignment mode setting process. When the alignment mode that is selected by the user is the rear side alignment mode (rear side in the step S3010), the CPU 952 sets the alignment mode as the rear side alignment mode (S3013), and finishes the alignment mode setting process. It should be noted that the established alignment mode is saved in the RAM 954.

After setting up the alignment mode in this way, the staple process is performed according to FIG. 15 described in the first embodiment.

Although a user is able to select the "AUTO DISCRIMINATION MODE" in the second embodiment, a process may be designed so that a user should always select either of the normal alignment mode, the front side alignment mode, or the rear side alignment mode without preparing the "AUTO DISCRIMINATION MODE".

As mentioned above, even if a plurality of types of sheets are mixed in one booklet, the optimal alignment process can be performed according to the post-processing mode, and the result aligned with sufficient accuracy can be acquired according to the second embodiment as with the first embodiment.

Moreover, in the second embodiment, a user can select a desired alignment mode easily.

In the case shown in FIG. 5 and FIG. 6, the finisher control unit 951, the motors, and the processing trays 630 function as the alignment unit as is evident from the above-mentioned description. Then, the finisher control unit 951 functions as the determination unit.

In the first and second embodiments, when not all the items in the sheet type information of the respective sheets match, it is determined that a plurality of types of sheets are mixed. However, if sheets are product of a manufacture trusted in the manufacture precision of sheets, it may be determined that a plurality of types of sheets are not mixed even if the manufacture lots in the sheet type information differ as long as the other items in the information match.

Although the embodiments of the invention have been described, the present invention is not limited to the above-mentioned embodiments, the present invention includes various modifications as long as the concept of the invention is not deviated.

For example, the functions of the above mentioned embodiments may be achieved as a control method that is executed by the sheet post-processing apparatus. Moreover, the functions of the above mentioned embodiments may be achieved as a control program that is executed by a computer with which the sheet post-processing apparatus is provided. It should be noted that the control program is recorded into a computer-readable storage medium, for example.

In this case, each of the control method and the control program has a first determination step, a second determination step, and an alignment step at least.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-001372, filed on Jan. 6, 2012, which is hereby incorporated by reference herein in its entirety.

What is claimed is:

1. A sheet post-processing apparatus comprising:

a conveyance unit configured to convey a sheet;

a sheet stacking unit configured to stack sheets conveyed by the conveyance unit as a sheet bundle;

a stapler configured to apply a staple process to the sheet bundle stacked on the sheet stacking unit;

a position determination unit configured to determine a staple position at which the staple process is applied to the sheet bundle; and an alignment unit configured to align the sheets stacked on the sheet stacking unit in a width direction that intersects perpendicularly with a conveyance direction of a sheet conveyed by the conveyance unit with respect to one of two sides of the sheet that are parallel to the sheet conveyance direction, the alignment unit determining the one side as a reference side depending on the staple position determined by the position determination unit, wherein the alignment unit comprises:

a first alignment member and a second alignment member each movable in the width direction; and a pushing unit separate from the first and second alignment members and configured to selectively push, on the basis of the staple position determined by the position determination unit, the sheet toward the first alignment member or the second alignment member.

2. The sheet post-processing apparatus according to claim 1, wherein the pushing unit is configured to selectively perform a first pushing process for pushing the sheet to the first alignment member, and a second pushing process for pushing the sheet to the second alignment member.

3. The sheet post-processing apparatus according to claim 2, wherein the pushing unit comprises a first alignment roller that pushes the sheet to the first alignment member, and a second alignment roller that pushes the sheet to the second alignment member.

4. The sheet post-processing apparatus according to claim 3, wherein each of the first and second alignment rollers is movable to come in contact with the surface on one side of the sheet and to be disposed away from the surface on one side of the sheet.

5. The sheet post-processing apparatus according to claim 1, wherein the stapler applies the staple process at a corner of the sheet bundle, and the alignment unit determines the reference side according to the position of the corner at which the staple process should be applied with the stapler.

6. The sheet post-processing apparatus according to claim 1, wherein the stapler applies the staple process at two points along one side of the sheet bundle, and the alignment unit determines the reference side according to the side at which the staple process should be applied with the stapler.

7. The sheet post-processing apparatus according to claim 1, wherein the alignment unit aligns the sheet bundle stacked on the stacking unit by pinching the sheet bundle with the first alignment member and the second alignment member, and then, aligns the top sheet of the sheet bundle with the pushing unit.

8. The sheet post-processing apparatus according to claim 2, wherein the alignment unit does not align the sheet bundle with the pushing unit if the staple process is not applied to the sheet bundle.

9. The sheet post-processing apparatus according to claim 1, further comprising:

a determination unit configured to determines whether a plurality of types of sheets are included in the sheet bundle, wherein the alignment unit does not perform either of the first and second pushing processes when the determination unit determines that a plurality of types of sheets are not included in the sheet bundle.

10. The sheet post-processing apparatus according to claim 9, wherein the determination unit determines a sheet type based on at least one of a sheet size, a basis weight, a shape, grain running, or a surface nature in sheet type information.

11. The sheet post-processing apparatus according to claim 1, further comprising:

a designation unit configured to designate manually the reference side for alignment, wherein the alignment unit determines the reference side for alignment depending on the staple position determined by the position determination unit when the reference side is not designated by the designation unit, and determines the reference side for alignment as the designated side irrespective of the staple position when the reference side is designated by the designation unit.

12. A sheet post-processing apparatus comprising:

a conveyance unit configured to convey a sheet;

a sheet stacking unit configured to stack sheets conveyed by the conveyance unit as a sheet bundle;

a stapler configured to apply a staple process to the sheet bundle stacked on the sheet stacking unit;

a position determination unit configured to determine a staple position at which the staple process is applied to the sheet bundle; and an alignment unit configured to align the sheets stacked on the sheet stacking unit in a width direction that intersects perpendicularly with a conveyance direction of a sheet conveyed by the conveyance unit with respect to one of two sides of the sheet that are parallel to the sheet conveyance direction, the alignment unit determining the one side as a reference side depending on the staple position determined by the position determination unit, wherein the alignment unit comprises a first alignment member and a second alignment member that oppose in the width direction, and a pushing unit configured to selectively perform a first pushing process for pushing a first side that is one of the two sides of the sheet to the first alignment member, and a second pushing process for pushing a second side that is the other of the two sides of the sheet to the second alignment member, and wherein the pushing unit comprises a first alignment roller that pushes the first side to the first alignment member, and a second alignment roller that pushes the second side to the second alignment member.

13. The sheet post-processing apparatus according to claim 12, wherein each of the first and second alignment rollers is movable to come in contact with the surface on one side of the sheet and to be disposed away from the surface on one side of the sheet.

14. A sheet post-processing apparatus comprising:

a conveyance unit configured to convey a sheet;

a sheet stacking unit configured to stack sheets conveyed by the conveyance unit as a sheet bundle;

a stapler configured to apply a staple process to the sheet bundle stacked on the sheet stacking unit;

a position determination unit configured to determine a staple position at which the staple process is applied to the sheet bundle;

an alignment unit configured to align the sheets stacked on the sheet stacking unit in a width direction that intersects perpendicularly with a conveyance direction of a sheet conveyed by the conveyance unit with respect to one of two sides of the sheet that are parallel to the sheet conveyance direction, the alignment unit determining the one side as a reference side depending on the staple position determined by the position determination unit; and a determination unit configured to determines whether a plurality of types of sheets are included in the sheet bundle, wherein the alignment unit not perform either the first pushing process or the second pushing process when the determination unit determines that a plurality of types of sheets are not included in the sheet bundle.

15. The sheet post-processing apparatus according to claim 14, wherein each of the first and second alignment rollers is movable to come in contact with the surface on one side of the sheet and to be disposed away from the surface on one side of the sheet.

* * * * *